US006857717B2

(12) United States Patent
Misumi

(10) Patent No.: US 6,857,717 B2
(45) Date of Patent: Feb. 22, 2005

(54) INKJET PRINTING APPARATUS, CONTROL METHOD THEREFOR, AND PROGRAM

(75) Inventor: Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 10/367,812

(22) Filed: Feb. 19, 2003

(65) Prior Publication Data

US 2003/0156147 A1 Aug. 21, 2003

(30) Foreign Application Priority Data

Feb. 19, 2002 (JP) ..... 2002-041835
Feb. 19, 2002 (JP) ..... 2002-041836

(51) Int. Cl.[7] ..... B41J 29/38
(52) U.S. Cl. ..... 347/14; 400/120.14; 347/17
(58) Field of Search ..... 347/170, 10, 11, 347/14, 19, 180, 184, 189, 209, 17; 400/120.14, 120.12, 120.05

(56) References Cited

U.S. PATENT DOCUMENTS 4,313,124 A 1/1982 Hara
4,345,262 A 8/1982 Shirato et al.
4,463,359 A 7/1984 Ayata et al.
4,723,129 A 2/1988 Endo et al.
4,740,796 A 4/1988 Endo et al.
4,910,528 A 3/1990 Firl et al.
5,559,535 A * 9/1996 Otsuka et al. ..... 347/14
5,610,638 A * 3/1997 Courtney ..... 347/14
5,745,132 A * 4/1998 Hirabayashi et al. ..... 347/14
6,022,092 A 2/2000 Misumi
6,109,718 A * 8/2000 Murakami et al. ..... 347/14
6,302,507 B1 * 10/2001 Prakash et al. ..... 347/14
6,328,407 B1 * 12/2001 Sengun ..... 347/17
6,394,571 B1 * 5/2002 Yano et al. ..... 347/17
6,406,113 B1 * 6/2002 Kato ..... 347/14
6,601,941 B1 * 8/2003 Jones ..... 347/17
6,612,673 B1 * 9/2003 Giere et al. ..... 347/14
6,641,242 B2 * 11/2003 Canti et al. ..... 347/17

FOREIGN PATENT DOCUMENTS

JP 6-155767 6/1994
JP 8-174865 7/1996
JP 8-183170 7/1996

* cited by examiner

*Primary Examiner*—Eugene H. Eickholt
(74) *Attorney, Agent, or Firm*—Fitzpatrick, Cella, Harper & Scinto

(57) ABSTRACT

Print data containing a specific print pattern and the number of paper sheets to be printed is input from an external interface. On the basis of the print pattern and the number of printing thereof to be printed, the temperature of an inkjet printhead is predicted by a program executed by a CPU. A drive signal for the inkjet printhead is set before the start of printing on the basis of the prediction result.

15 Claims, 24 Drawing Sheets

| HEAD TEMPERATURE (℃) | PULSE WIDTH (μs) | | | RANK |
|---|---|---|---|---|
| | P1 | P2 | P3 | |
| 25 ~ 29 | 0.65 | 0.50 | 1.65 | 1 |
| 30 ~ 34 | 0.65 | 0.40 | 1.65 | 2 |
| 35 ~ 39 | 0.65 | 0.30 | 1.65 | 3 |
| 40 ~ 44 | 0.65 | 0.20 | 1.65 | 4 |
| 45 ~ 49 | 0.65 | 0.10 | 1.65 | 5 |
| 50 ~ 54 | 0 | 0 | 2.20 | 6 |
| 55 ~ 59 | 0 | 0 | 2.03 | 7 |
| 60 ~ 64 | 0 | 0 | 1.86 | 8 |
| 65 ~ 69 | 0 | 0 | 1.69 | 9 |
| 70 ~ 74 | 0 | 0 | 1.52 | 10 |

FIG. 10A

| NUMBER OF SHEETS TO BE PRINTED | TEMPER-ATURE RISE ΔT°C | NUMBER OF SHEETS TO BE PRINTED | TEMPER-ATURE RISE ΔT°C | NUMBER OF SHEETS TO BE PRINTED | TEMPER-ATURE RISE ΔT°C | NUMBER OF SHEETS TO BE PRINTED | TEMPER-ATURE RISE ΔT°C | NUMBER OF SHEETS TO BE PRINTED | TEMPER-ATURE RISE ΔT°C | NUMBER OF SHEETS TO BE PRINTED | TEMPER-ATURE RISE ΔT°C |
|---|---|---|---|---|---|---|---|---|---|---|---|
| 0 | 0 | 50 | 14 | 100 | 20 | 150 | 20 | 200 | 24 | 250 | 25 |
| 1 | 2 | 51 | 15 | 101 | 20 | 151 | 20 | 201 | 24 | 251 | 25 |
| 2 | 3 | 52 | 15 | 102 | 20 | 152 | 20 | 202 | 25 | 252 | 25 |
| 3 | 3 | 53 | 15 | 103 | 20 | 153 | 20 | 203 | 25 | 253 | 25 |
| 4 | 4 | 54 | 15 | 104 | 20 | 154 | 21 | 204 | 25 | 254 | 25 |
| 5 | 4 | 55 | 15 | 105 | 21 | 155 | 21 | 205 | 25 | 255 | 25 |
| 6 | 4 | 56 | 15 | 106 | 21 | 156 | 21 | 206 | 25 | 256 | 25 |
| 7 | 5 | 57 | 16 | 107 | 21 | 157 | 21 | 207 | 25 | 257 | 25 |
| 8 | 5 | 58 | 16 | 108 | 21 | 158 | 21 | 208 | 25 | 258 | 25 |
| 9 | 5 | 59 | 16 | 109 | 21 | 159 | 21 | 209 | 25 | 259 | 25 |
| 10 | 6 | 60 | 16 | 110 | 21 | 160 | 21 | 210 | 25 | 260 | 25 |
| 11 | 6 | 61 | 16 | 111 | 21 | 161 | 21 | 211 | 25 | 261 | 25 |
| 12 | 6 | 62 | 16 | 112 | 21 | 162 | 21 | 212 | 25 | 262 | 25 |
| 13 | 7 | 63 | 16 | 113 | 21 | 163 | 21 | 213 | 25 | 263 | 25 |
| 14 | 7 | 64 | 16 | 114 | 21 | 164 | 21 | 214 | 25 | 264 | 25 |
| 15 | 7 | 65 | 17 | 115 | 21 | 165 | 21 | 215 | 25 | 265 | 25 |
| 16 | 7 | 66 | 17 | 116 | 21 | 166 | 21 | 216 | 25 | 266 | 25 |
| 17 | 8 | 67 | 17 | 117 | 21 | 167 | 21 | 217 | 25 | 267 | 25 |
| 18 | 8 | 68 | 17 | 118 | 21 | 168 | 21 | 218 | 25 | 268 | 25 |
| 19 | 8 | 69 | 17 | 119 | 21 | 169 | 21 | 219 | 25 | 269 | 25 |
| 20 | 8 | 70 | 17 | 120 | 21 | 170 | 21 | 220 | 25 | 270 | 25 |
| 21 | 9 | 71 | 17 | 121 | 21 | 171 | 22 | 221 | 25 | 271 | 25 |
| 22 | 9 | 72 | 17 | 122 | 22 | 172 | 22 | 222 | 25 | 272 | 25 |
| 23 | 9 | 73 | 17 | 123 | 22 | 173 | 22 | 223 | 25 | 273 | 25 |
| 24 | 9 | 74 | 18 | 124 | 22 | 174 | 22 | 224 | 25 | 274 | 25 |
| 25 | 10 | 75 | 18 | 125 | 22 | 175 | 22 | 225 | 25 | 275 | 25 |

FIG. 10B

| NUMBER OF SHEETS TO BE PRINTED | TEMPER-ATURE RISE ΔT℃ | NUMBER OF SHEETS TO BE PRINTED | TEMPER-ATURE RISE ΔT℃ | NUMBER OF SHEETS TO BE PRINTED | TEMPER-ATURE RISE ΔT℃ | NUMBER OF SHEETS TO BE PRINTED | TEMPER-ATURE RISE ΔT℃ | NUMBER OF SHEETS TO BE PRINTED | TEMPER-ATURE RISE ΔT℃ | NUMBER OF SHEETS TO BE PRINTED | TEMPER-ATURE RISE ΔT℃ |
|---|---|---|---|---|---|---|---|---|---|---|---|
| 26 | 10 | 76 | 18 | 126 | 22 | 176 | 22 | 226 | 25 | 276 | 25 |
| 27 | 10 | 77 | 18 | 127 | 22 | 177 | 22 | 227 | 25 | 277 | 25 |
| 28 | 10 | 78 | 18 | 128 | 22 | 178 | 22 | 228 | 25 | 278 | 25 |
| 29 | 10 | 79 | 18 | 129 | 22 | 179 | 22 | 229 | 25 | 279 | 25 |
| 30 | 11 | 80 | 18 | 130 | 22 | 180 | 22 | 230 | 25 | 280 | 25 |
| 31 | 11 | 81 | 18 | 131 | 22 | 181 | 22 | 231 | 25 | 281 | 25 |
| 32 | 11 | 82 | 18 | 132 | 22 | 182 | 22 | 232 | 25 | 282 | 25 |
| 33 | 11 | 83 | 19 | 133 | 22 | 183 | 22 | 233 | 25 | 283 | 25 |
| 34 | 11 | 84 | 19 | 134 | 22 | 184 | 22 | 234 | 25 | 284 | 25 |
| 35 | 12 | 85 | 19 | 135 | 22 | 185 | 22 | 235 | 25 | 285 | 25 |
| 36 | 12 | 86 | 19 | 136 | 22 | 186 | 22 | 236 | 25 | 286 | 25 |
| 37 | 12 | 87 | 19 | 137 | 22 | 187 | 22 | 237 | 25 | 287 | 25 |
| 38 | 12 | 88 | 19 | 138 | 22 | 188 | 22 | 238 | 25 | 288 | 25 |
| 39 | 12 | 89 | 19 | 139 | 22 | 189 | 22 | 239 | 25 | 289 | 25 |
| 40 | 13 | 90 | 19 | 140 | 22 | 190 | 22 | 240 | 25 | 290 | 25 |
| 41 | 13 | 91 | 19 | 141 | 22 | 191 | 22 | 241 | 25 | 291 | 25 |
| 42 | 13 | 92 | 20 | 142 | 22 | 192 | 22 | 242 | 25 | 292 | 25 |
| 43 | 13 | 93 | 20 | 143 | 22 | 193 | 23 | 243 | 25 | 293 | 25 |
| 44 | 13 | 94 | 20 | 144 | 23 | 194 | 23 | 244 | 25 | 294 | 25 |
| 45 | 13 | 95 | 20 | 145 | 23 | 195 | 23 | 245 | 25 | 295 | 25 |
| 46 | 13 | 96 | 20 | 146 | 23 | 196 | 23 | 246 | 25 | 296 | 25 |
| 47 | 14 | 97 | 20 | 147 | 23 | 197 | 23 | 247 | 25 | 297 | 25 |
| 48 | 14 | 98 | 20 | 148 | 23 | 198 | 23 | 248 | 25 | 298 | 25 |
| 49 | 14 | 99 | 20 | 149 | 23 | 199 | 24 | 249 | 25 | 299 | 25 |

ΔT25℃C EVEN AFTER 300 SHEETS

FIG. 11

| PRINT START HEAD TEMPERATURE (℃) | DUTY RATIO IN BLOCK (%) | | | | | | | |
|---|---|---|---|---|---|---|---|---|
| | 0～12 | 13～25 | 26～37 | 38～50 | 51～62 | 63～75 | 76～87 | 88～100 |
| 25～29 | 1 | 1 | 2 | 3 | 4 | 4 | 5 | 6 |
| 30～34 | 1 | 2 | 3 | 3 | 4 | 5 | 6 | 6 |
| 35～39 | 2 | 2 | 3 | 4 | 5 | 5 | 6 | 7 |
| 40～44 | 2 | 3 | 4 | 4 | 5 | 6 | 7 | 7 |
| 45～49 | 3 | 3 | 4 | 5 | 6 | 6 | 7 | 8 |
| 50～54 | 3 | 4 | 5 | 5 | 6 | 7 | 8 | 8 |
| 55～59 | 4 | 4 | 5 | 6 | 7 | 7 | 8 | 9 |
| 60～64 | 4 | 4 | 6 | 6 | 7 | 8 | 9 | 9 |
| 65～69 | 5 | 5 | 6 | 7 | 8 | 8 | 9 | 10 |
| 70～74 | 5 | 6 | 7 | 7 | 8 | 9 | 10 | 10 |

FIG. 18

| SIMULTANEOUS DISCHARGE COUNT | VOLTAGE DROP (V) | PULSE WIDTH (μs) | PULSE CORRECTION VALUE (μs) |
|---|---|---|---|
| 1 | 0.00 | 2.30 | 0.00 |
| 2 | 0.26 | 2.35 | 0.05 |
| 3 | 0.39 | 2.40 | 0.10 |
| 4 | 0.52 | 2.45 | 0.15 |
| 5 | 0.65 | 2.50 | 0.20 |
| 6 | 0.78 | 2.50 | 0.20 |
| 7 | 0.91 | 2.55 | 0.25 |
| 8 | 1.04 | 2.60 | 0.30 |
| 9 | 1.17 | 2.65 | 0.35 |
| 10 | 1.30 | 2.70 | 0.40 |
| 11 | 1.43 | 2.75 | 0.45 |
| 12 | 1.56 | 2.80 | 0.50 |
| 13 | 1.69 | 2.85 | 0.55 |
| 14 | 1.82 | 2.90 | 0.60 |
| 15 | 1.95 | 2.90 | 0.60 |
| 16 | 2.08 | 2.95 | 0.65 |
| 17 | 2.21 | 3.05 | 0.75 |
| 18 | 2.34 | 3.10 | 0.80 |
| 19 | 2.46 | 3.15 | 0.85 |
| 20 | 2.59 | 3.20 | 0.90 |
| 21 | 2.72 | 3.25 | 0.95 |
| 22 | 2.85 | 3.30 | 1.00 |
| 23 | 2.98 | 3.35 | 1.05 |
| 24 | 3.11 | 3.45 | 1.15 |
| 25 | 3.24 | 3.50 | 1.20 |
| 26 | 3.37 | 3.55 | 1.25 |
| 27 | 3.50 | 3.65 | 1.35 |
| 28 | 3.63 | 3.70 | 1.40 |
| 29 | 3.76 | 3.75 | 1.45 |
| 30 | 3.89 | 3.85 | 1.55 |
| 31 | 4.02 | 3.90 | 1.60 |
| 32 | 4.15 | 4.00 | 1.70 |
| 33 | 4.28 | 4.10 | 1.80 |
| 34 | 4.41 | 4.15 | 1.85 |
| 35 | 4.54 | 4.25 | 1.95 |
| 36 | 4.67 | 4.35 | 2.05 |
| 37 | 4.80 | 4.45 | 2.15 |
| 38 | 4.93 | 4.50 | 2.20 |

FIG. 22

| DUTY RATIO | VOLTAGE DROP (V) | PULSE CORRECTION VALUE (μs) |
|---|---|---|
| ⋮ | ⋮ | ⋮ |
| 25 | 0.3 | 0.07 |
| ⋮ | ⋮ | ⋮ |
| 50 | 0.6 | 0.13 |
| ⋮ | ⋮ | ⋮ |
| 100 | 1.2 | 0.36 |

INKJET PRINTING APPARATUS, CONTROL METHOD THEREFOR, AND PROGRAM

FIELD OF THE INVENTION

The present invention relates to an inkjet printing apparatus which continuously prints a print pattern using a printhead, a control method therefor, and a program.

BACKGROUND OF THE INVENTION

Printing apparatuses such as printers, copying machines, and facsimile apparatuses are designed to print an image formed from a dot pattern on a printing material such as a paper sheet or thin plastic plate on the basis of image information. Such printing apparatuses can be classified into inkjet printing apparatuses, wire dot printing apparatuses, thermal printing apparatuses, laser beam printing apparatuses, and the like in accordance with their printing schemes. Of these schemes, the inkjet scheme (inkjet printing apparatus) is designed to print an image by discharging ink (printing liquid) droplets from the orifices of a printhead and causing the droplets to fly and land on a printing material.

As many printing apparatuses are used in recent years, they are required to realize high-speed printing, high resolution, high image quality, and low noise level. An inkjet printing apparatus can meet these requirements. In an inkjet printing apparatus which prints an image by discharging ink from a printhead, the temperature of ink at the discharge section has a strong influence on stable ink discharge and stable ink discharge amount, which are necessary for meeting the above requirements. More specifically, if the ink temperature is too low, the ink viscosity excessively increases. This makes it impossible to discharge the ink by normal discharge energy. Conversely, if the ink temperature is too high, the discharge amount excessively increases to cause ink overflow on a printing paper sheet, resulting in poor image quality.

To prevent this, conventional inkjet printing apparatuses have a temperature sensor at the printhead portion and employ a method of controlling the ink temperature at the discharge section within a desired range on the basis of the detected temperature of the printhead or a method of controlling a discharge recovery process.

As a heater for temperature control, a heater member joined to the printhead portion is used. Some inkjet printing apparatuses which print an image by forming flying droplets using thermal energy, i.e., some apparatuses which discharge ink droplets by growing bubbles by film boiling of ink, use a discharge heater itself as a heater for temperature control. Especially, when the discharge heater is used, the heater must be energized not to grow ink bubbles.

In a printing apparatus which obtains ink droplets to be discharged by forming bubbles in solid ink or liquid ink using thermal energy, the discharge characteristic largely changes depending on the temperature of the printhead. It is therefore particularly important to manage the ink temperature at the discharge section and the printhead temperature that greatly influences the ink temperature.

In managing the printhead temperature, it is important to measure the ink temperature at the discharge section which has a large influence on the discharge characteristic. However, it is very difficult to measure the ink temperature because the discharge section also generates heat, and this makes the detection temperature of the temperature sensor largely vary more than the variation in ink temperature necessary for management, and also because the ink itself moves. For these reasons, even when a temperature sensor is simply arranged near the printhead to accurately measure the ink temperature at the time of discharging, the variation in temperature of the ink itself can hardly be measured.

An inkjet printing apparatus has been proposed, which stabilizes the ink temperature indirectly by stabilizing the printhead temperature as an ink temperature management means. U.S. Pat. No. 4,910,528 discloses an inkjet printer which has a means for stabilizing the printhead temperature by predicting a subsequent discharge heater driving amount in a predetermined time using, as a reference, the detection temperature of a temperature sensor arranged near the discharge heater.

More specifically, the apparatus stabilizes the printhead temperature by controlling, in accordance with the predicted temperature, a printhead heating means, a discharge heater energization means, a carriage driving control means for maintaining the printhead temperature to a predetermined value or less, a carriage scanning delay means, a means for reducing the carriage scanning speed, a means for changing the printing sequence of ink droplet discharge from the printhead, and the like.

However, the inkjet printer disclosed in U.S. Pat. No. 4,910,528 has a measurement error of the temperature sensor and a time lag between reading by the temperature sensor and reflection of the reading result on driving. It cannot sufficiently stabilize discharge in recent high-speed printing. In addition, since the printhead incorporates the temperature sensor, the cost of printhead increases. Hence, no inexpensive printing apparatus can be provided.

SUMMARY OF THE INVENTION

The present invention has been made to solve the above problems, and has as its object to provide an inkjet printing apparatus which can accurately predict the printhead temperature and stabilize discharge in accordance with a variation in head temperature with a simple and inexpensive arrangement, a control method therefor, and a program.

According to the present invention, the forefoing object is attained by providing an inkjet printing apparatus which continuously prints a specific print pattern using a printhead, comprising:

input means for inputting print data containing the specific print pattern and the number of printing thereof to be printed;

prediction means for predicting a temperature of the printhead on the basis of the specific print pattern and the number of printing thereof to be printed; and setting means for setting a drive signal for the printhead before start of printing on the basis of a prediction result from the prediction means.

In a preferred embodiment, the apparatus further comprises calculation means for calculating a duty ratio of the specific print pattern, first storage means for storing a continuous printing temperature rise prediction table that represents a relationship between the number of printing to print the specific print pattern and a temperature rise for the duty ratio of the specific print pattern, and second storage means for storing a setting table used to set the drive signal for the printhead on the basis of the temperature of the printhead and the duty ratio of a predetermined block in the specific print pattern, wherein the prediction means predicts the temperature of the printhead on the basis of the specific print pattern and the number of printing to be printed by looking up the continuous printing temperature rise prediction table, and the setting means sets the drive signal for the printhead before the start of printing on the basis of the temperature of the printhead, which is predicted by the prediction means, by looking up the setting table.

In a preferred embodiment, the apparatus further comprises temperature detection means for detecting an ambient temperature of the inkjet printing apparatus, and the prediction means predicts the temperature of the printhead on the basis of the ambient temperature, the specific print pattern, and the number of printing to be printed.

In a preferred embodiment, the predetermined block is one of a block obtained by dividing the specific print pattern by a first predetermined length in a printing/scanning direction and a block obtained by dividing the specific print pattern by the first predetermined length and by a second predetermined length in a direction perpendicular to the printing/scanning direction.

In a preferred embodiment, the drive signal is formed from a divided pulse having one or a plurality of pre-pulses and a main pulse for one cycle of printing operation.

In a preferred embodiment, the setting means sets a waveform of the divided pulse of the drive signal before the start of printing.

In a preferred embodiment, the setting means sets an interval between the pre-pulse and the main pulse of the drive signal before the start of printing.

According to the present invention, the foregoing object is attained by providing a method of controlling an inkjet printing apparatus which continuously prints a specific print pattern using a printhead, comprising:

an input step of inputting print data containing the specific print pattern and the number of printing thereof to be printed;

a prediction step of predicting a temperature of the printhead on the basis of the specific print pattern and the number of printing thereof to be printed; and a setting step of setting a drive signal for the printhead before start of printing on the basis of a prediction result in the prediction step.

According to the present invention, the foregoing object is attained by providing a program which causes a computer to function to control an inkjet printing apparatus which continuously prints a specific print pattern using a printhead, comprising:

a program code for an input step of inputting print data containing the specific print pattern and the number of printing thereof to be printed;

a program code for a prediction step of predicting a temperature of the printhead on the basis of the specific print pattern and the number of printing thereof to be printed; and a program code for a setting step of setting a drive signal for the printhead before start of printing on the basis of a prediction result in the prediction step.

According to the present invention, the foregoing object is attained by providing an inkjet printing apparatus which prints a specific print pattern using a printhead having a plurality of printing elements which discharge ink, comprising:

input means for inputting print data containing the specific print pattern;

calculation means for calculating a simultaneous discharge count of the plurality of printing elements in one cycle of discharge operation of the printhead on the basis of the specific print pattern;

prediction means for predicting a voltage variation in drive voltage of the printhead on the basis of the simultaneous discharge count; and setting means for setting a drive signal for the printhead before start of printing on the basis of a prediction result from the prediction means.

In a preferred embodiment, the calculation means calculates the simultaneous discharge count of the plurality of printing elements in one cycle of the discharge operation of the printhead for each printing element array of the printhead.

In a preferred embodiment, the apparatus further comprises storage means for storing a voltage variation prediction table used to predict the voltage variation corresponding to the simultaneous discharge count, the prediction means predicts the voltage variation of the printhead on the basis of the simultaneous discharge count by looking up the voltage variation prediction table, and the setting means sets the drive signal for the printhead before the start of printing on the basis of the voltage variation predicted by the prediction means.

In a preferred embodiment, the apparatus further comprises calculation means for calculating a duty ratio of the specific print pattern, first storage means for storing a first voltage variation prediction table used to predict the voltage variation corresponding to the simultaneous discharge count, and second storage means for storing a second voltage variation prediction table used to predict the voltage variation corresponding to the duty ratio of the specific print pattern, wherein the prediction means predicts a first voltage variation of the drive voltage in one cycle of discharge operation of the printhead on the basis of the simultaneous discharge count by looking up the first voltage variation prediction table and predicts a second voltage variation of the drive voltage in the printing operation of the specific print pattern on the basis of the duty ratio of the specific print pattern by looking up the second voltage variation prediction table, and the setting means sets the drive signal for the printhead before the start of printing on the basis of the first and second voltage variations predicted by the prediction means.

In a preferred embodiment, the drive signal is formed from a divided pulse having one or a plurality of pre-pulses and a main pulse for one cycle of discharge operation.

In a preferred embodiment, the setting means sets a waveform of the divided pulse of the drive signal before the start of printing.

According to the present invention, the foregoing object is attained by providing a method of controlling an inkjet printing apparatus which prints a specific print pattern using a printhead having a plurality of printing elements which discharge ink, comprising:

an input step of inputting print data containing the specific print pattern;

a calculation step of calculating a simultaneous discharge count of the plurality of printing elements in one cycle of discharge operation of the printhead on the basis of the specific print pattern;

a prediction step of predicting a voltage variation in drive voltage of the printhead on the basis of the simultaneous discharge count; and a setting step of setting a drive signal for the printhead before start of printing on the basis of a prediction result in the prediction step.

According to the present invention, the foregoing object is attained by providing a program which causes a computer to function to control an inkjet printing apparatus which prints a specific print pattern using a printhead having a plurality of printing elements which discharge ink, comprising:

a program code for an input step of inputting print data containing the specific print pattern;

a program code for a calculation step of calculating a simultaneous discharge count of the plurality of printing elements in one cycle of discharge operation of the printhead on the basis of the specific print pattern;

a program code for a prediction step of predicting a voltage variation in drive voltage of the printhead on the basis of the simultaneous discharge count; and a program code for a setting step of setting a drive signal for the printhead before start of printing on the basis of a prediction result in the prediction step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 10A and 10B are tables forming a continuous printing temperature rise prediction table according to the first embodiment of the present invention;

FIG. 11 is a table showing the application pulse condition setting table according to the first embodiment of the present invention;

FIG. 18 is a table showing a voltage variation prediction table according to the third embodiment of the present invention;

FIG. 22 is a table showing a voltage variation prediction table according to the fourth embodiment of the present invention.

DETAILED DESCRIPTION OF THE PREFERRED EMBODIMENTS

Preferred embodiments of the present invention will be described below in detail with reference to the accompanying drawings.

In this specification, "printing" means not only formation of significant information such as characters or graphic patterns but also formation of images, designs, and patterns or processing of a medium by applying a liquid to a printing medium whether it is significant or insignificant information and whether it is made obvious for human visual perception.

A "printing material" means not only a paper sheet used in a general printing apparatus but also a material capable of accepting ink discharged from a printhead, such as cloth, a plastic film, or a metal plate.

"Ink" should also be interpreted in a broad sense, as in the above definition of "printing". "Ink" means a liquid which is applied to a printing medium to form images, designs, and patterns or process the printing medium.

(First Embodiment)

Figure 1:
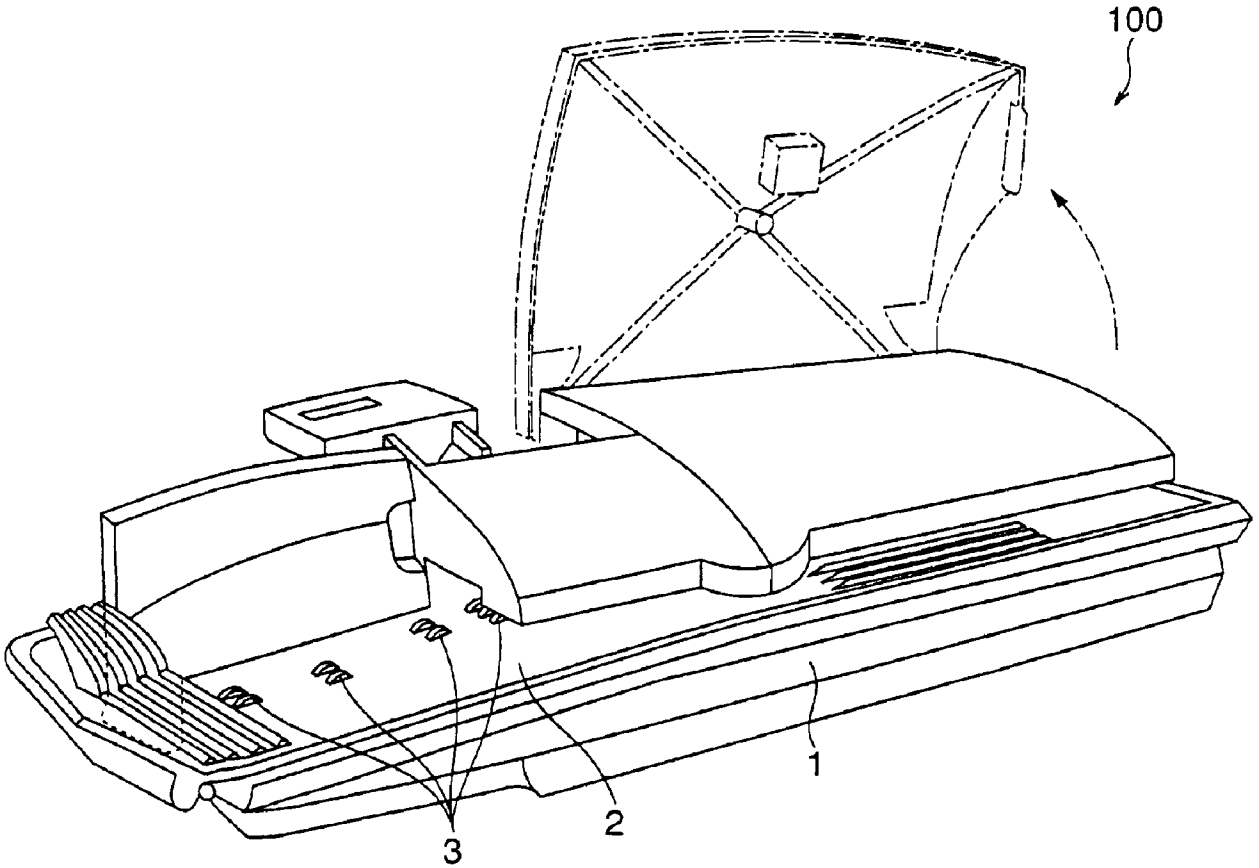
FIG. 1 is a perspective view showing the outer appearance of an inkjet printing apparatus according to the first embodiment of the present invention.
Figure 2:
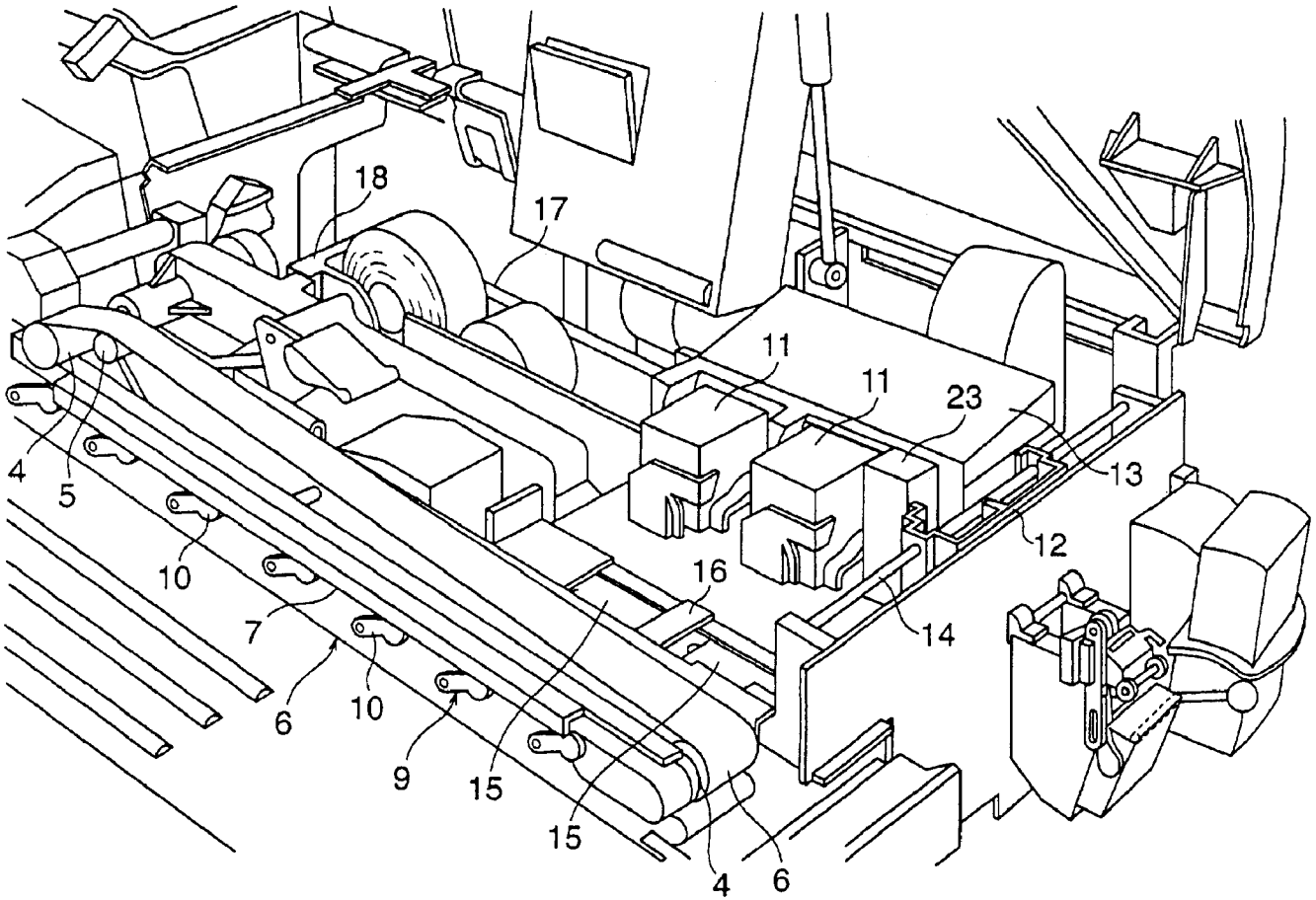
FIG. 2 is a perspective view showing the internal arrangement of the inkjet printing apparatus according to the first embodiment of the present invention.
Figure 3:
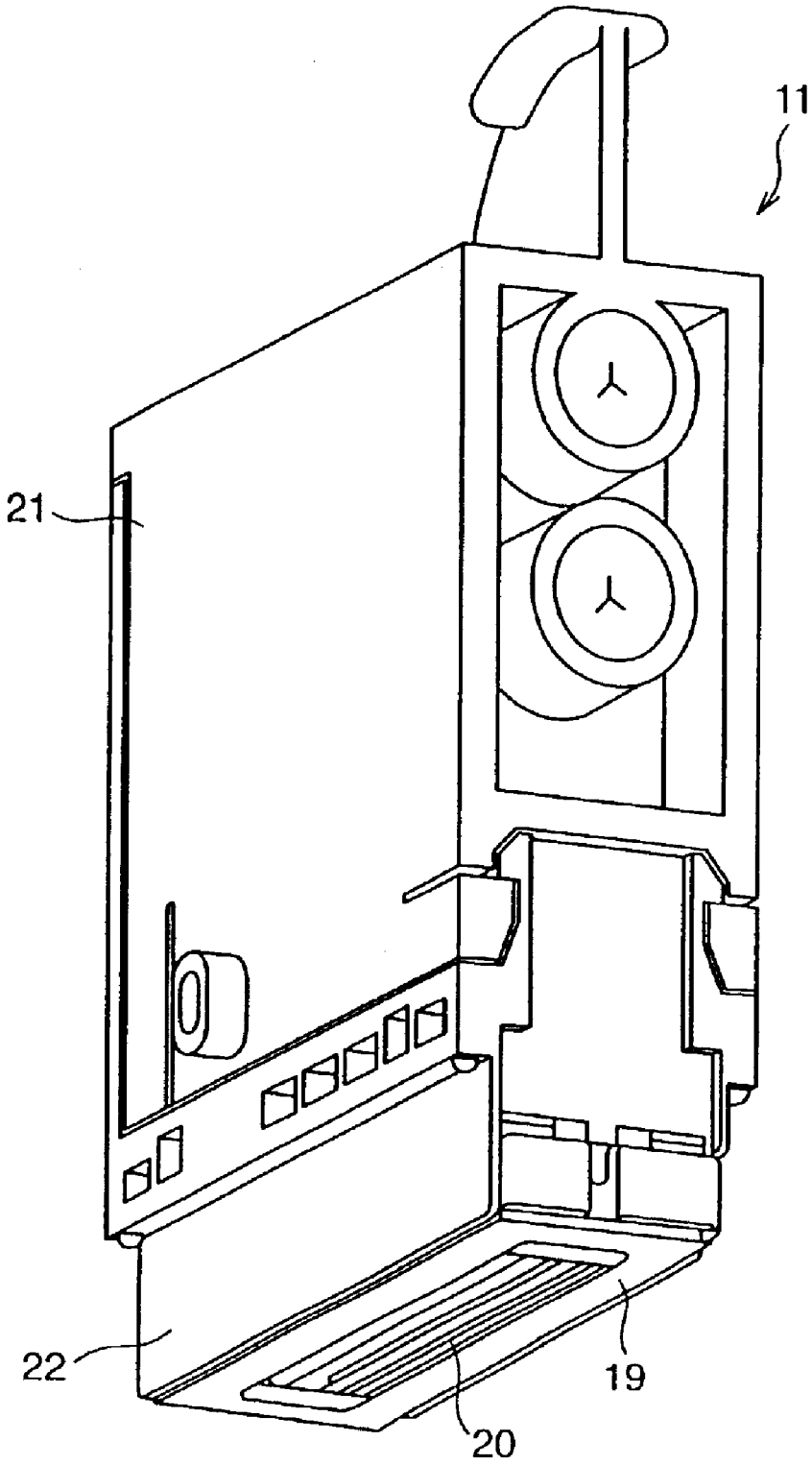
FIG. 3 is a perspective view showing the outer appearance of an inkjet printhead according to the first embodiment of the present invention.

FIG. 1 is a perspective view showing the outer appearance of an inkjet printing apparatus according to the first embodiment of the present invention. FIG. 2 is a perspective view showing the internal arrangement of the inkjet printing apparatus according to the first embodiment of the present invention. FIG. 3 is a perspective view showing the outer appearance of an inkjet printhead according to the first embodiment of the present invention.

Referring to FIG. 1, an inkjet printing apparatus 100 including a guide plate 2 has a frame 1 which supports all constituent elements of the apparatus. The lower surface of the guide plate 2 forms a feed path through which a printing material is fed together with the printing surface as the upper surface of the printing material (not shown) and an endless belt.

The printing material is fed along the feed path by the lower running surface of the belt that projects from the long slit of the guide plate 2 in cooperation with a plurality of push rollers 3. Especially, referring to FIG. 1, two arrays of push rollers 3 are formed to ensure to support the printing material and press it flat against the lower surface of the guide plate 2. The push rollers 3 are rotatably attached to the free ends of arms. The arms are pivotally connected to an appropriate housing as part of the frame 1 and pressed upward against the printing material by a biasing means such as a spring.

Referring to FIG. 2, a belt 6 is supported by a pair of feed rollers 4. One feed roller 4 is driven by a motor. A tape having an indefinite length is stored in the inkjet printing apparatus 100 as a roll attached to the housing. The tape is fed upward from the roll by the pair of feed rollers 4. A feed roller 5 functions to help feeding the tape to a throat formed by the lower surface of the guide plate 2 and the upper surface of a pressure plate 7. The pressure plate 7 is movably attached to press the tape against the lower surface of the guide plate 2 in response to a spring 9 accommodated between the pressure plate 7 and the housing formed on the frame 1.

The tape is drawn to the printing position by another pair of feed rollers 10. After a print pattern is printed by an inkjet printhead 11, the tape is cut from the strip. Tapes with a predetermined length are fed one by one to the extraction position. The feed rollers 4 and 5 and the feed rollers 10 are driven by motors connected to the pairs of feed rollers.

As shown in FIG. 2, the tape moving path formed by the position of the tape and the positions of the pair of feed rollers 4 and 5, pressure plate 7, and feed rollers 10 is offset from and set in parallel to the printing material feed path. The feed paths of the tape and printing material are separated.

The inkjet printhead 11 is attached to a pair of parallel rails 13 spaced apart by a slidable bracket 12. The rails 13 are supported by a fixed bracket 14 attached to the frame 1 and extend in a direction perpendicular to the feed direction of the printing material and tape in the inkjet printing apparatus 100. The inkjet printhead 11 is moved back and forth along the rails 13 by the endless belt 6 supported by a pair of rollers 15. One of the rollers 15 is driven by a reversible motor 17. The inkjet printhead 11 is connected to a belt 16 by a bracket 18.

As shown in FIG. 3, the inkjet printhead 11 has a nozzle plate 19. The nozzle plate 19 has a nozzle array 20 which is formed from an array of orifices of printing elements (nozzles) for discharging droplets. Under the control of software, small ink droplets are discharged in a predetermined pattern such that a predetermined image is formed on a printing material that moves through the inkjet printhead 11. The nozzle array 20 is arranged to be almost perpendicular to the moving direction along the feed path of the printing material or tape.

Especially, the inkjet printhead 11 is constructed by a printing unit section 21 which has a droplet discharge section for discharging droplets from the nozzle array 20 in accordance with a print signal and a sheet wiring member such as a flexible cable or a TAB on which electrical interconnections for transferring a print signal transmitted from the printing apparatus main body, and a printing liquid storage unit section 22 (to be referred to as a frame body hereinafter) which has a printing liquid storage chamber (common liquid chamber) for storing a printing liquid to be supplied to the printing unit section 21 and also serves as a package for holding the printing unit section 21.

The inkjet printhead 11 employs a form of a so-called cartridge which is detachably mounted on a carriage 23 of the inkjet printing apparatus 100.

(Control Arrangement)

A functional arrangement for executing printing control of each constituent element of the inkjet printing apparatus 100 described above will be described next with reference to FIG. 4.

Figure 4:
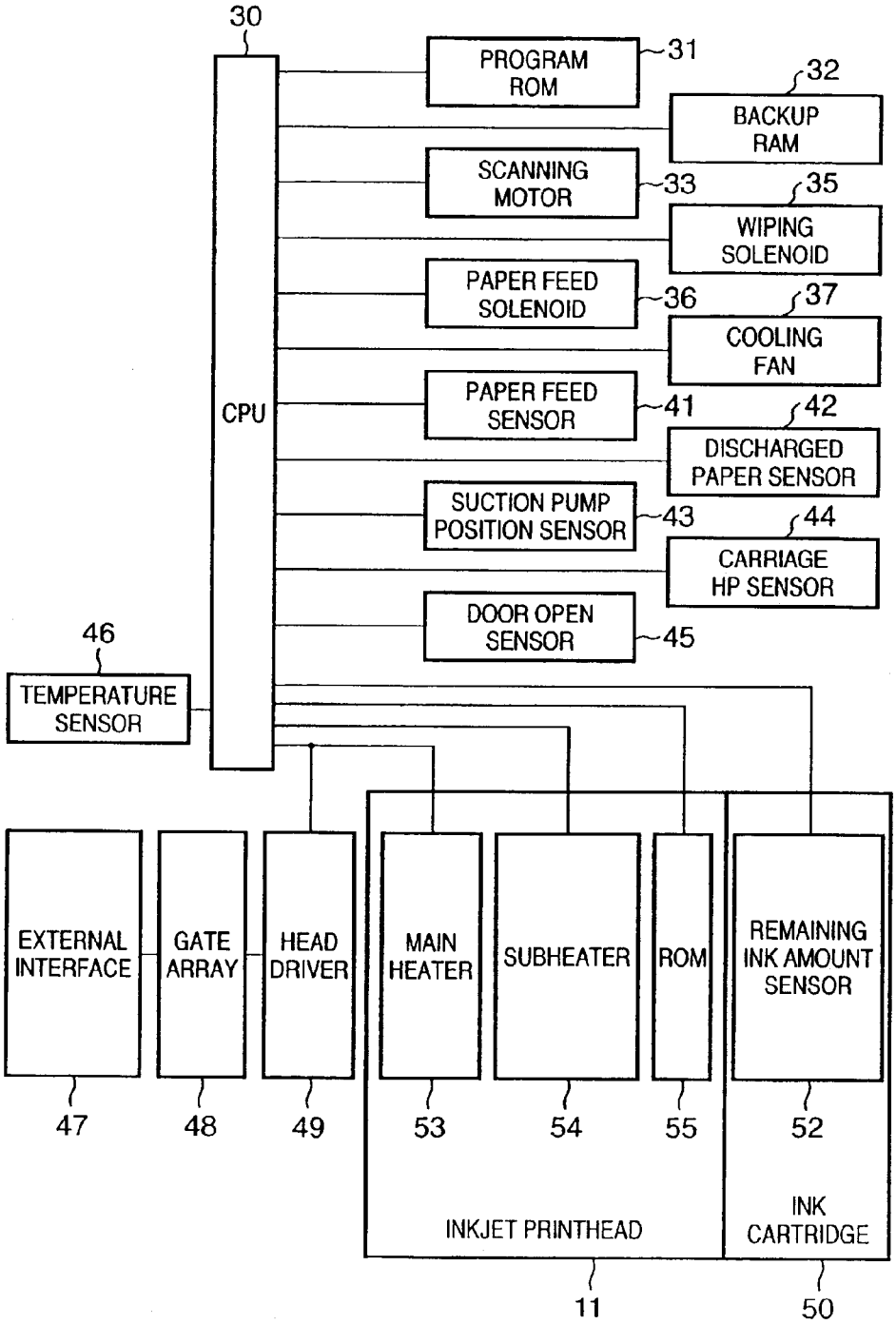
FIG. 4 is a block diagram showing the functional arrangement of the inkjet printing apparatus according to the first embodiment of the present invention.

FIG. 4 is a block diagram showing the functional arrangement of the inkjet printing apparatus according to the first embodiment of the present invention.

Referring to FIG. 4, reference numeral 30 denotes a CPU. A program ROM 31 stores a control program to be executed by the CPU 30. A backup RAM 32 stores various data. A scanning motor 33 is used to convey a printing material. The scanning motor 33 is also used for suction/recovery operation of the inkjet printhead 11 by a suction pump. A wiping solenoid 35 is used for wiping control. A paper feed solenoid 36 is used for paper feed control. A cooling fan 37 is used to air-cool the inkjet printing apparatus 100.

A paper feed sensor 41 detects the presence/absence of a printing material. A discharged paper sensor 42 detects the presence/absence of a printed printing material. A suction pump position sensor 43 detects the position of the suction pump. A carriage HP sensor 44 detects the home position (HP) of the carriage 23. A door open sensor 45 detects the open/closed state of the door. A temperature sensor 46 measures the ambient temperature (internal temperature) of the inkjet printing apparatus 100.

An external interface 47 connects an external device such as a host computer for generating print data to the inkjet printing apparatus 100. A gate array 48 controls print data supply to a head driver 49. The head driver 49 drives the inkjet printhead 11 on the basis of print data. Reference numeral 50 denotes an ink cartridge. The ink cartridge 50 has a remaining ink amount sensor 52 for detecting the remaining amount of ink.

The inkjet printhead 11 has a main heater 53 used to discharge ink, a subheater 54 for controlling the temperature of the inkjet printhead 11, and a ROM 55 which stores various kinds of information of the inkjet printhead 11.

The operation of the above arrangement will be described. When print data is input to the external interface 47, a print signal is converted between the gate array 48 and the CPU 30 into print data to be used for printing. The motor driver is driven, and the inkjet printhead 11 is driven in accordance with the print data sent to the external interface 47, thus executing printing.

The inkjet printhead 11 has a channel wall member that forms a channel communicating with a plurality of orifices, and a liquid chamber with an ink supply port. In this case, ink ejected from the ink supply port is stored in the internal common liquid chamber and supplied to the channel. In this state, a heating element arranged on the board is driven to discharge the ink from the orifices.

Figure 5:
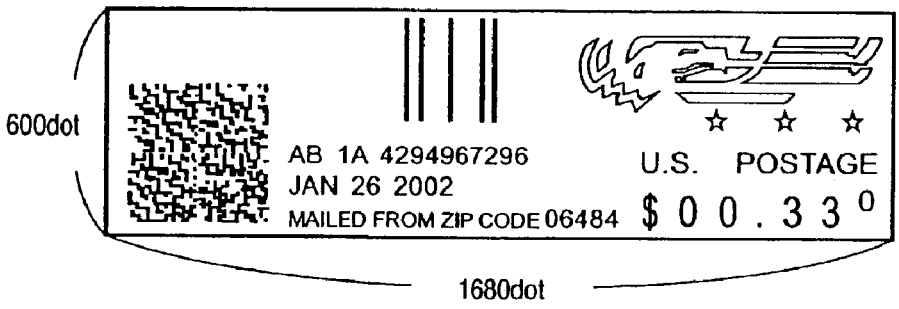
FIG. 5 is a view showing a specific pattern according to the first embodiment of the present invention.

In the first embodiment, for example, a specific print pattern as shown in FIG. 5 is continuously printed by the inkjet printhead 11

(Outline of Temperature Prediction and Input Pulse Setting)

In the first embodiment, for continuous printing of a specific pattern, even when the ambient temperature or the temperature of the inkjet printhead 11 before the start of printing is higher than 25° C. (room temperature), the temperature rise of the inkjet printhead 11 is predicted whereby an application pulse condition that realizes an almost uniform discharge amount like at the room temperature is set. The temperature rise prediction is divisionally executed as temperature rise prediction for continuous printing of a specific pattern and that in the specific pattern.

For temperature rise prediction in continuous printing, prediction processing of predicting the temperature rise on the basis of the duty ratio in the entire area of a specific pattern is executed. On the basis of the prediction result and the duty ratio (image printing density) of each of predetermined blocks obtained by dividing the specific pattern into blocks, an application pulse condition is set by considering (predicting) the temperature rise of the printhead by the duty ratio of each block.

Accordingly, the application pulse condition at which an almost uniform discharge amount is obtained like at the room temperature can be set before the start of printing. Hence, stable discharge can be realized with a simpler arrangement.

The temperature rise prediction will be described while exemplifying continuous printing of the specific pattern shown in FIG. 5.

The specific pattern (a postal stamp pattern in the first embodiment) is formed from pixels including vertical 600 dots in the same direction as that of the nozzle array direction of the inkjet printhead 11 and horizontal 1,680 dots in the convey direction of a printing material (an envelope in the first embodiment).

The vertical 600 dots of the specific pattern have a density of 600 dpi. The horizontal 1,680 dots have a density of 300 dpi. Ink droplets are discharged from the inkjet printhead 11 at a driving frequency of 15 kHz so that the specific pattern is continuously printed on printing materials (envelopes). The printing speed is 260 envelopes/min. Hence, the time necessary for printing one specific pattern is 112 ms. The passage time of one envelope is 230 ms.

For this specific pattern, the horizontal 1,680 dots are segmented into 100 blocks. A duty ratio (image printing density) is calculated for each block (vertical 600 dots× horizontal 168 dots) by processing to be described later.

Figure 6:
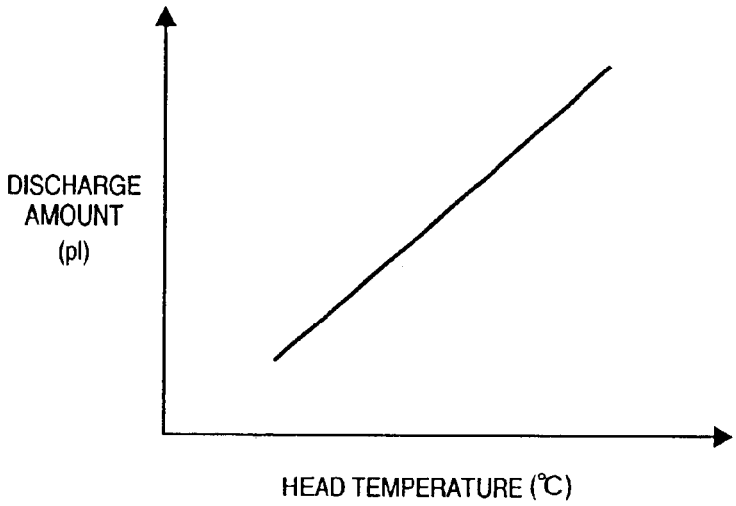
FIG. 6 is a graph showing the temperature rise characteristic of the inkjet printhead according to the first embodiment of the present invention.

When a predetermined pulse (drive signal) is supplied to discharge ink droplets, the inkjet printhead 11 has the head temperature vs. discharge amount change characteristic as shown in FIG. 6, as is apparent from experiments conducted by the present inventor. That is, as the head temperature increases, the discharge amount linearly increases.

Especially, as the drive signal, a double pulse made of short and long pulses is conventionally used.

In one cycle of discharge operation, the temperature of ink around the heating element can be increased by applying a short pulse (pre-pulse) that does not cause ink discharge, and then, the ink discharge amount can be increased by applying a long pulse (main pulse), unlike single pulse application.

When the pre-pulse width or the interval between the pre-pulse and the main pulse is changed, the discharge amount can be controlled. In addition, when the main pulse width is controlled, the power supply necessary for ink discharge, which changes depending on the variation in resistance value of the heating element, can be adjusted. That is, when pulse width modulation (application pulse condition) is set, including control/modulation of the pre-pulse width, main pulse width, and the interval between the pre-pulse and the main pulse, discharge can be stabilized.

A detailed example of the pulse width modulation will be described below.

Figure 7:
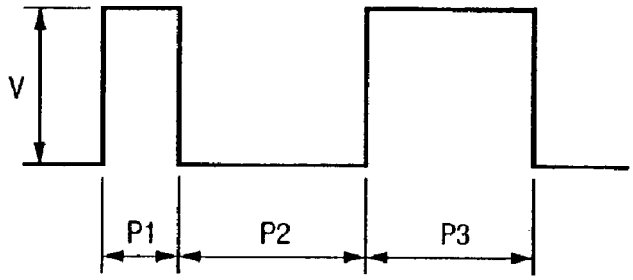
FIG. 7 is a table showing the application pulse conditions of the inkjet printhead according to the first embodiment of the present invention.

FIG. 7 shows application pulse conditions in various temperature ranges. An application pulse condition, i.e., an input pulse condition including a pre-pulse width P1 in a region where no bubbles are formed in ink droplets, a pulse width P3 in a region where bubbles are formed in ink droplets, and a pulse application OFF time P2 between the pulses P1 and P3 is changed in accordance with the temperature of the inkjet printhead 11 with respect to a making voltage V. Each application pulse condition has a rank value representing its contents.

Figure 8:
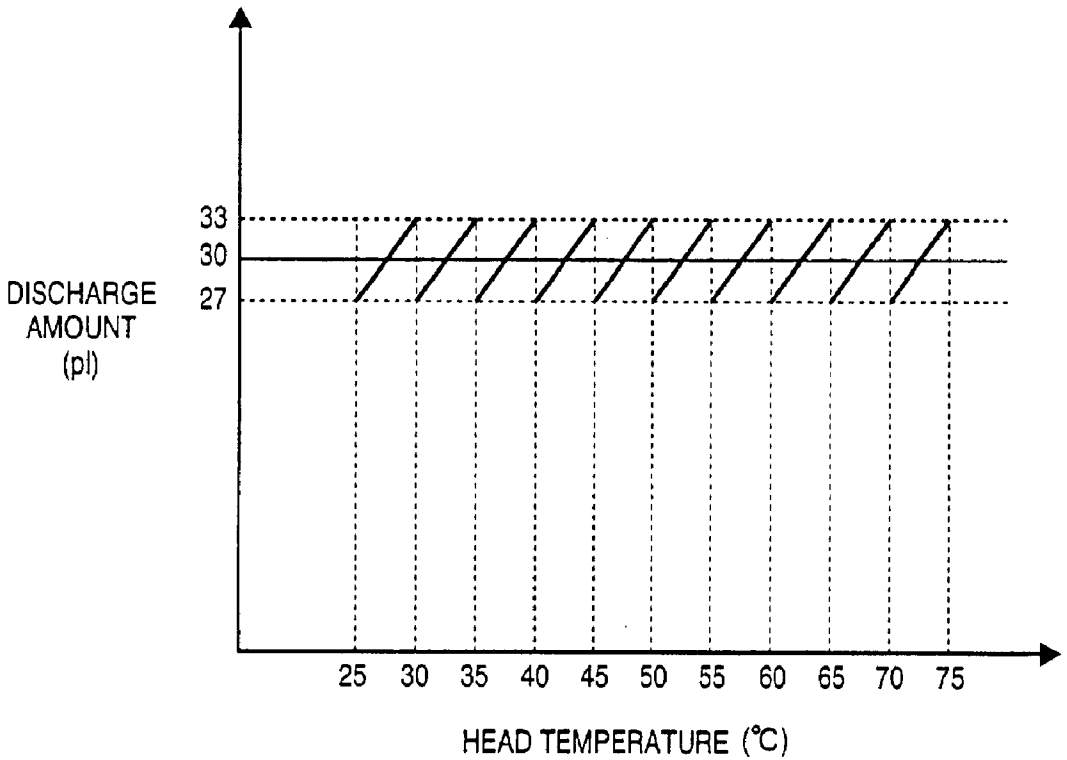
FIG. 8 is a graph showing the temperature rise characteristic of the inkjet printhead according to the first embodiment of the present invention.

When the application pulse conditions shown in FIG. 7 are set, the discharge characteristic shown in FIG. 6 changes to that in FIG. 8. In this case, the discharge amount from the inkjet printhead 11 falls within the range of 30±3 pl. Within this discharge amount range, no variation in density is visually observed. With such pulse width modulation setting processing, an almost uniform discharge amount can be obtained for one specific pattern. Hence, the discharge can be stabilized.

FIG. 7 shows an example in which the drive signal corresponding to one cycle of discharge operation is formed from one pre-pulse and one main pulse. However, the number of pre-pulses is not limited to one. The drive signal may be formed from a plurality of pre-pulses and one main pulse. A drive signal which corresponds to one cycle of discharge operation and is formed from one or a plurality of pre-pulses and one main pulse is generally called a divided pulse. A pulse group including one pre-pulse and one main pulse is called a double pulse.

In the first embodiment, the waveform of the divided pulse is controlled by pulse width modulation setting processing, thereby stabilizing discharge. Control of the waveform of the divided pulse includes control of the pulse width of at least one of the pre-pulse and main pulse, control of the interval between the pre-pulse and the main pulse, and control of the pulse heights of the pre-pulse and main pulse.

The above-described pulse width modulation setting processing can effectively be performed when the ambient temperature equals the room temperature (25° C.), and the temperature of the inkjet printhead 11 before the start of printing also equals the room temperature. However, the pulse width modulation setting for the inkjet printhead 11 must be changed when the ambient temperature has changed, or a printing history just before the processing is present (when the head temperature does not equal the room temperature).

Figure 9:
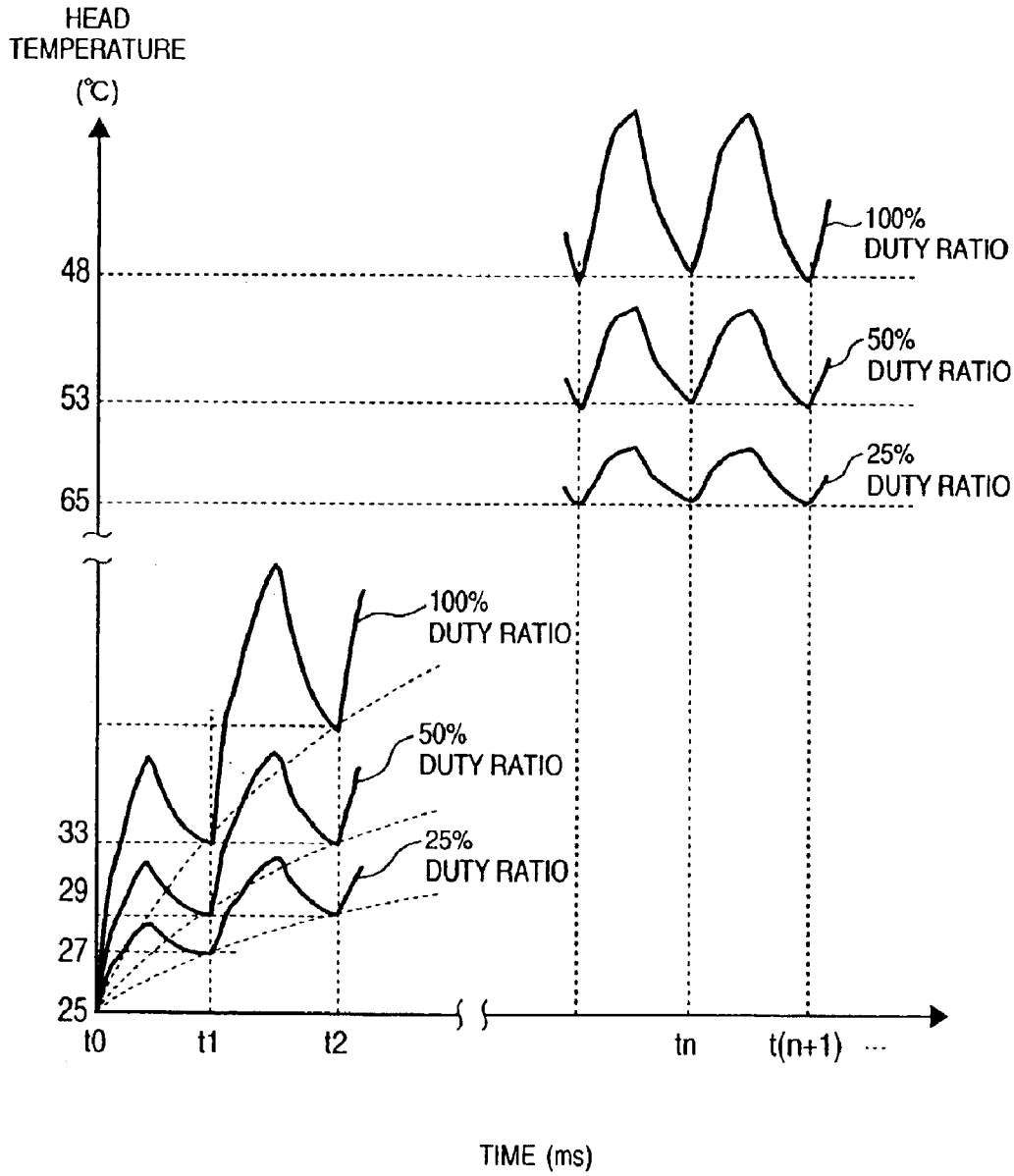
FIG. 9 is a graph showing the temperature rise characteristic of the inkjet printhead according to the first embodiment of the present invention.

For example, when the duty ratio in the entire region of 600 dots×1680 dots of the specific pattern shown in FIG. 5 is changed, and the specific pattern is continuously printed on envelopes, temperature rise characteristics shown in FIG. 9 are obtained.

Referring to FIG. 9, t1, t2, t3, . . . , tn indicate the temperature rises for the respective envelopes, and tn is the time required for printing of n envelopes.

FIGS. 10A and 10B show an example of the relationship between the number of printed paper sheets and temperature rises ΔT obtained on the basis of the temperature rise characteristics shown in FIG. 9. FIGS. 10A and 10B are the continuous printing temperature rise prediction tables that indicate the relationship between the number of printed paper sheets (or the number of printing) and the temperature rises ΔT when a specific pattern with a duty ratio of 15% is continuously printed on printing materials. Actually, continuous printing temperature rise prediction tables at arbitrary duties except 15% are present.

The inkjet printhead 11 is actually driven, and the temperature rise characteristic for each duty ratio of each of the segmented blocks of one specific pattern is measured. On the basis of the measurement results and head temperatures, application pulse conditions at which an almost uniform discharge amount is realized like at the room temperature are obtained, thereby forming an application pulse condition setting table. FIG. 11 shows the table.

The numbers determined by the head temperatures and duty ratios in FIG. 11 correspond to rank values shown in FIG. 7. One rank value is defined by a head temperature and duty ratio. Accordingly, an optimum application pulse condition in printing of each block can be set.

A detailed example will be described. For example, assume that 101 envelopes should be continuously printed. When continuous printing is started at the room temperature of 25° C., and 100 envelopes have been printed, the temperature rise ΔT=20° C. The predicted head temperature is 25 (room temperature)+20 (temperature rise ΔT)=45° C. When the duty ratio of the first segmented block of the specific pattern on the 101st envelope is 30%, i.e., when the head temperature at the start of printing the 101st envelope is 45° C., and the duty ratio in the segmented block is 30%, the application pulse condition rank is "4", as is apparent from FIG. 11. That is, in this case, the application pulse condition includes P1=0.65, P2=0.20, and P3=1.65 (μs). This is the application pulse condition (pulse width condition) when the first block of the specific pattern is to be printed on the 101st envelope.

When this processing is repeated, an application pulse condition for each segmented block of the specific pattern can be set. Especially in the first embodiment, since the contents of the specific pattern to be printed are known in advance, the application pulse condition (P1, P2, and P3) for each segmented block of the specific pattern can be set before the start of printing in accordance with the number of sheets to be printed.

Processing executed by the inkjet printing apparatus 100 of the first embodiment will be described next with reference to FIG. 12.

Figure 12:
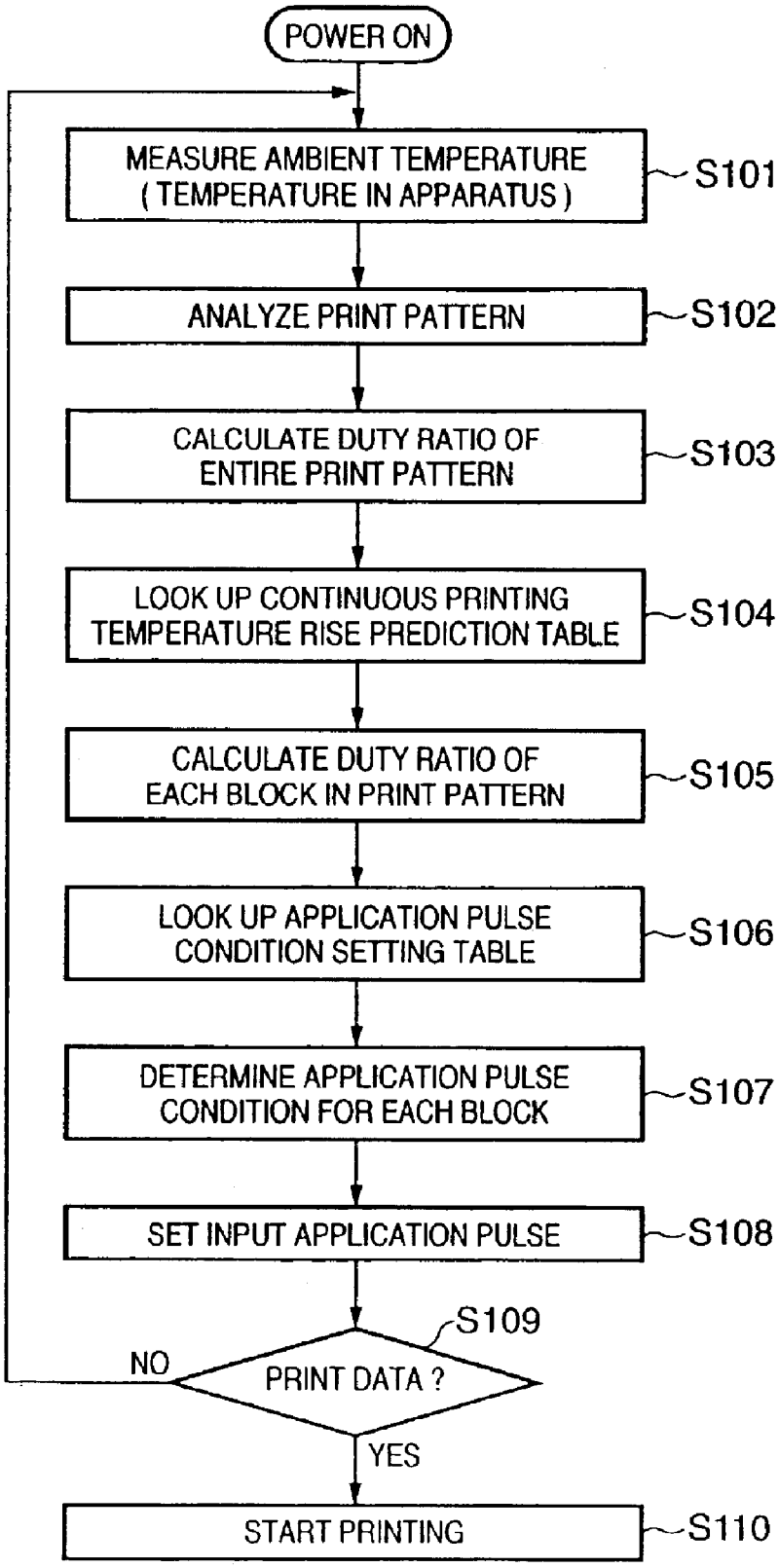
FIG. 12 is a flow chart showing processing executed by the inkjet printing apparatus according to the first embodiment of the present invention.

FIG. 12 is a flow chart showing processing executed by the inkjet printing apparatus according to the first embodiment of the present invention.

The processing executed in FIG. 12 may be realized by causing the CPU 30 to read out and execute a program stored in the program ROM 31 in the inkjet printing apparatus 100 or by dedicated hardware. The above-described application pulse conditions (FIG. 7), continuous printing temperature rise prediction tables (FIGS. 10A and 10B), and application pulse condition setting table (FIG. 11) are stored in, e.g., the program ROM 31 or backup RAM 32.

In step S101, the apparatus is powered on. The ambient temperature (temperature in the apparatus) is measured by the temperature sensor 46 in the inkjet printing apparatus 100. In step S102, print data containing a print pattern and the number of paper sheets to be printed is received from an external device through the external interface 47. The print pattern in the print data is analyzed.

In step S103, the duty ratio in the entire print pattern region is calculated. In step S104, the temperature rise ΔT corresponding to the duty ratio of the entire pattern region is determined as a predicted temperature rise by looking up the continuous printing temperature rise prediction tables (FIGS. 10A and 10B).

In step S106, the print pattern is segmented into predetermined blocks, and the duty ratio of each block is calculated. In the first embodiment, the print pattern is segmented into 100 blocks, and the duty ratio of each block is calculated.

In step S107, the application pulse condition for printing of each block is determined on the basis of the predicted head temperature obtained from the measured ambient temperature and determined temperature rise ΔT and the duty ratio of each block by looking up the application pulse condition setting table (FIG. 11).

In step S108, an input application pulse to be used to print each block is set in accordance with the determined application pulse condition.

In step S109, the presence/absence of print data is determined. If no print data is present (NO in step S109), the flow returns to step S101. If print data is present (YES in step S109), the flow advances to step S110 to start printing based on the print data.

As described above, according to the first embodiment, the temperature rise of the inkjet printhead 11 is predicted on the basis of the duty ratio of a specific pattern and the number of sheets to be printed. In accordance with the prediction result, an optimum application pulse condition of input pulses can be set. Accordingly, discharge can be stabilized, and a high-quality image with a uniform density can be obtained.

The inkjet printhead 11 has no temperature sensor. Instead, the head temperature is predicted in advance on the basis of the specific pattern, thereby setting the application pulse condition of input pulses for ink discharge before the start of printing. Unlike the prior art, no complex and unreliable discharge stabilizing means needs to be used. It is therefore unnecessary to arrange a temperature sensor in the inkjet printhead, read the temperature sensor at a time interval of several msec, and set the application pulse condition of input pulses on the basis of the read temperature. The inkjet printing apparatus main body and inkjet printhead can be simplified. The cost can be largely reduced, and the discharge can be stabilized. Hence, an inexpensive and high-quality inkjet printing apparatus can be provided.

(Second Embodiment)

In the first embodiment, the horizontal 1,680 dots of the specific pattern are segmented into blocks. The vertical 600 dots may also be segmented into blocks, and the duty ratio for each of the obtained matrix blocks may be calculated and used to set the application pulse condition in accordance with the duty ratio of each block. In this case, the discharge can more accurately be stabilized as compared to the first embodiment.

In the first embodiment, the application pulse condition (pulse width) is controlled. Instead, the number of times of predischarge, the predischarge interval, and suction/recovery condition may also be controlled together in accordance with the duty ratio of the specific pattern. For example, for a print pattern with a low duty ratio, the number of times of predischarge can be decreased to increase the predischarge interval. In addition, the suction/recovery amount can be suppressed to increase the suction/recovery interval.

When the print pattern and the number of sheets to be printed are known, all application pulse conditions based on various conditions described above can be set before the start of printing. When printing starts, printing operation can be uniquely performed on the basis of the sequence and pulse width control based on the set application pulse conditions without feeding back the inkjet printhead state to the apparatus main body or changing the settings.

(Third Embodiment)

A printhead using an inkjet printing scheme is formed from orifices which are formed to discharge a liquid, a liquid discharge portion which communicates with the orifices, and having a liquid channel includes, as a component, a heat acting portion at which thermal energy necessary for discharging the liquid acts on the liquid, and a board portion (chip) having an electrothermal transducer (heating element) for generating the thermal energy.

In recent years, such a board portion can have, in a single substrate, not only a plurality of heating elements but also a driver for each heating element, a shift register whose number of shifts for parallelly transferring, to the driver, image data bits that are serially input one by one has the same number of bits, and a control logic circuit such as a latch circuit for temporarily storing data output from the shift register.

To further increase the printing speed, long heads, such as a full-line head, have been developed. When the board portion of a printhead of an inkjet printing scheme is manufactured in accordance with the length of the printhead, the yield greatly decreases, and the cost inevitably increases. To form a long head without decreasing the yield, a plurality of board portions (chips) each having the printing width of a conventional printhead are arrayed to form a long head. To perform printing using such an arrangement, a method of dividing the plurality of chips of the printhead into blocks and time-divisionally driving the blocks is employed.

In the above case, however, the number of blocks is limited because of factors such as a driving period. If the number of connected chips is increased, the difference in energization voltage between the simultaneously driven blocks becomes very large between a voltage necessary for ink discharge from one nozzle of a block and a voltage necessary for ink discharge from all nozzles belonging to the block. Accordingly, a difference is generated in energy applied to the heating elements due to the variation in voltage by the wiring resistance in the chips. For some input image data, a printing error may occur due to the shortage of energy. Conversely, an excessive energy is applied to the heating elements, resulting in short service life of the printhead.

In the third embodiment, an arrangement for solving this problem will be described.

The same reference numerals as in the first embodiment shown in FIGS. 1 to 5 denote the same constituent elements in the third embodiment, and a description thereof will be omitted.

First, the arrangement of the control logic circuit of the board portion of an inkjet printhead 11 will be described with reference to FIG. 13.

Figure 13:
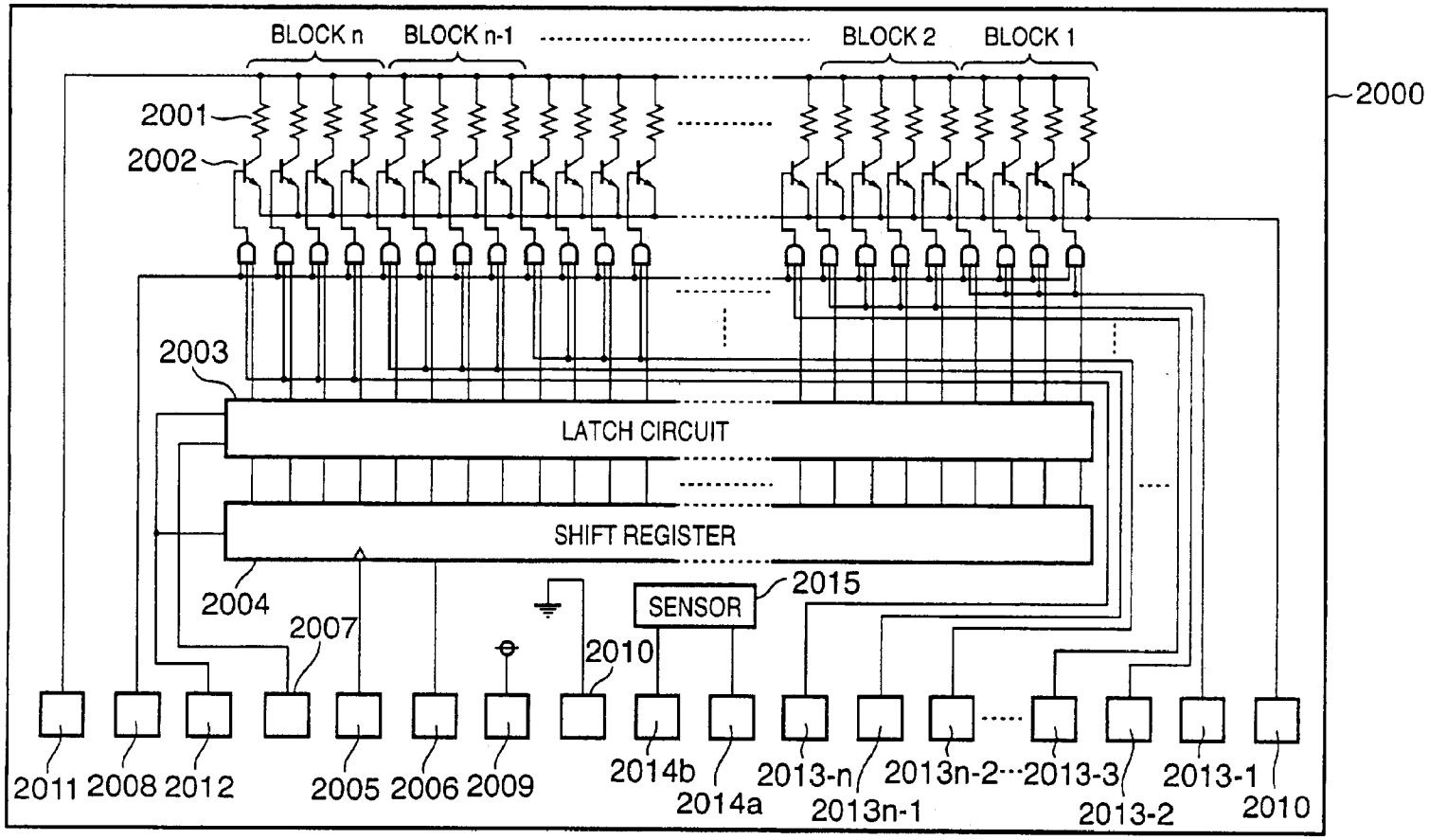
FIG. 13 is a block diagram showing the arrangement of the control logic circuit of the board portion of an inkjet printhead according to the third embodiment of the present invention.

FIG. 13 is a block diagram showing the arrangement of the control logic circuit of the board portion of an inkjet printhead according to the third embodiment of the present invention.

Referring to FIG. 13, reference numeral 2000 denotes a board; 2001, heating elements; 2002, power transistors; 2003, a latch circuit; 2004, a shift register; and 2015, a sensor used to monitor the resistance value of the heating elements 2001 and the board temperature.

Reference numerals 2005 to 2014 denote input pads.

More specifically, the input pads include the clock input pad 2005 which inputs a signal to operate the shift register, the image data input pad 2006 which serially inputs image data, the latch input pad 2007 which inputs a latch clock to make the latch circuit 2003 hold the image data, the input pad 2008 which inputs a drive signal (heat pulse or heat signal) to externally control the ON time of the power transistors 2002, i.e., the time in which a current is supplied to the heating elements 2001 to drive it, the block selection signal (block enable) input pads 2013-1 to 2013-n which select, for time-divisional driving, blocks obtained by dividing the 4n heating elements 2001 into n blocks (blocks 1, 2, . . . , n−1, and n in FIG. 13) each having four elements, the input pad 2012 which inputs a reset signal to initialize the shift register 2004 and latch circuit 2003, the input pads 2014*a* and 2014*b* which input sensor drive signals, the input pad 2009 which inputs a logic circuit drive voltage (5V), the GND terminal 2010, and the input pad 2011 which inputs a heating element driving power supply.

The driving sequence of the inkjet printhead 11 having the above arrangement will be described below.

First, image data is serially transmitted from the inkjet printing apparatus 100 main body to the board 2000 of the inkjet printhead 11 in synchronism with a clock. The shift register 2004 receives the image data through the image data input pad 2006.

The received image data is temporarily stored in the latch circuit 2003. The latch circuit 2003 outputs an ON/OFF signal in accordance with the value of the image data. In this state, when a drive signal is input from the input pad 2008, one or a plurality of power transistors 2002 corresponding to a selected block and image data with an "ON" value are driven for a period while the drive signal is ON.

Accordingly, a current flows to one or a plurality of heating elements 2001 to generate thermal energy which forms bubbles in ink on the heating elements 2001 and discharges the ink.

Figure 14:
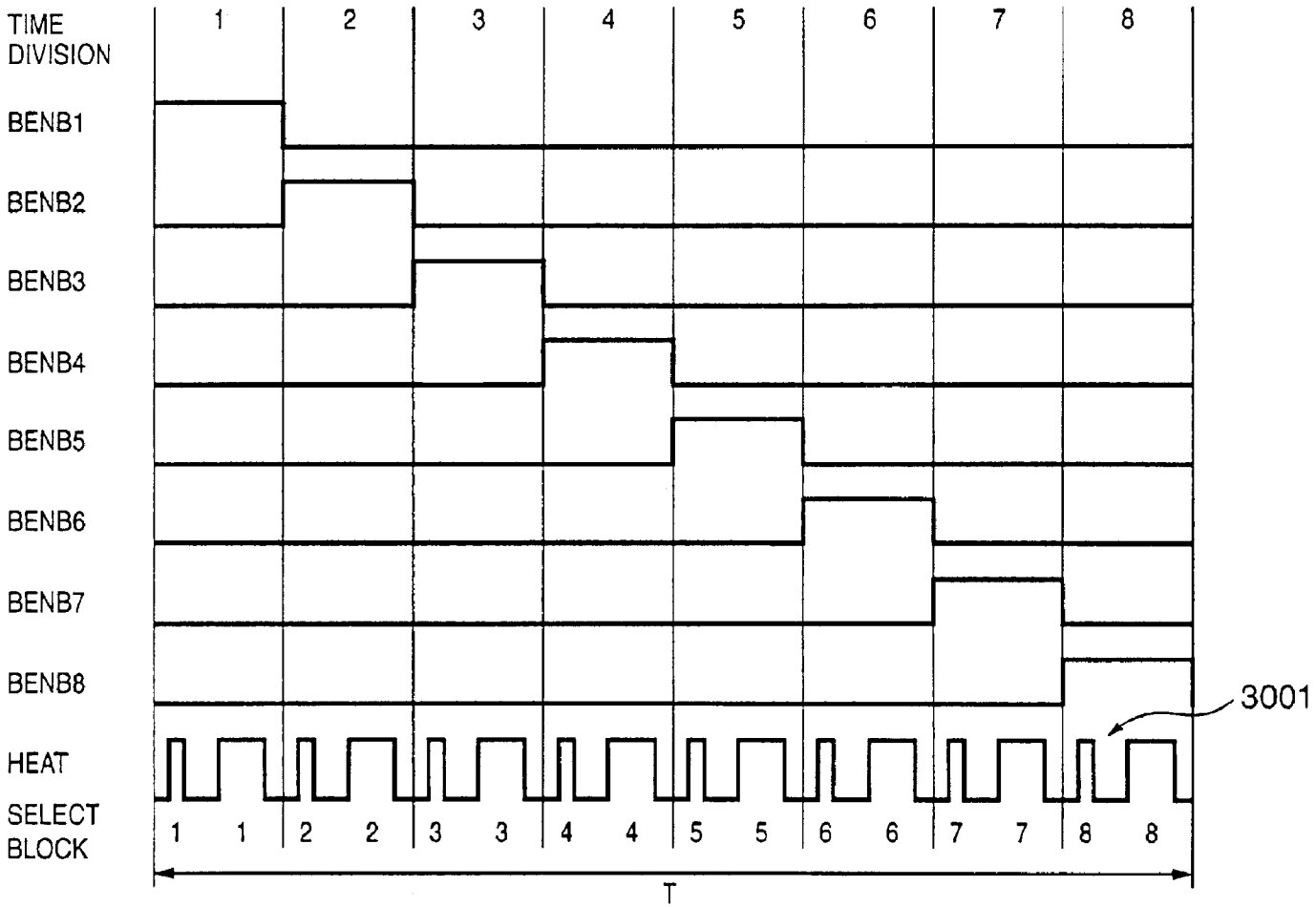
FIG. 14 is a timing chart showing signals to be applied to the inkjet printhead according to the third embodiment of the present invention.

FIG. 14 is a timing chart showing signals (heat signal and block selection signal) to be applied to the inkjet printhead 11 having a total of 304 heating elements which are divided into "8 (=n)" blocks each including "38" heating elements.

Referring to FIG. 14, BENB indicates a block selection signal for selecting a block. When BENB is "H", heating elements or power transistors to which the signal is connected can be driven.

When the value of image data is "H", and Heat (heat signal) changes to "H", corresponding heating elements or power transistors are driven. T represents the period of one cycle of printing operation by time-divisional control. SELECT BLOCK represents a signal that designates a selection block signal in time-divisional driving.

As indicated by 3001 in FIG. 14, a double pulse made of short and long pulses is used as a heat signal.

The temperature of ink around the heating elements can be increased by applying a short pulse (pre-pulse) that does not cause ink discharge, and then, the ink discharge amount can be increased by applying a long pulse (main pulse), unlike single pulse application.

When the width of the pre-pulse or the interval between the pre-pulse and the main pulse is changed, the discharge amount can be controlled. In addition, when the main pulse width is controlled, the power supply necessary for ink discharge, which changes depending on the variation in resistance value of the heating element, can be adjusted.

(Voltage Variation Correction)

In the third embodiment, the number of nozzles to be actually used for ink discharge (simultaneous discharge count) in the nozzle array of the inkjet printhead 11 is calculated on the basis of a print pattern, and a variation in drive voltage, which is generated in accordance with the simultaneous discharge count is corrected. The correction method will be described below in detail.

Figure 15:
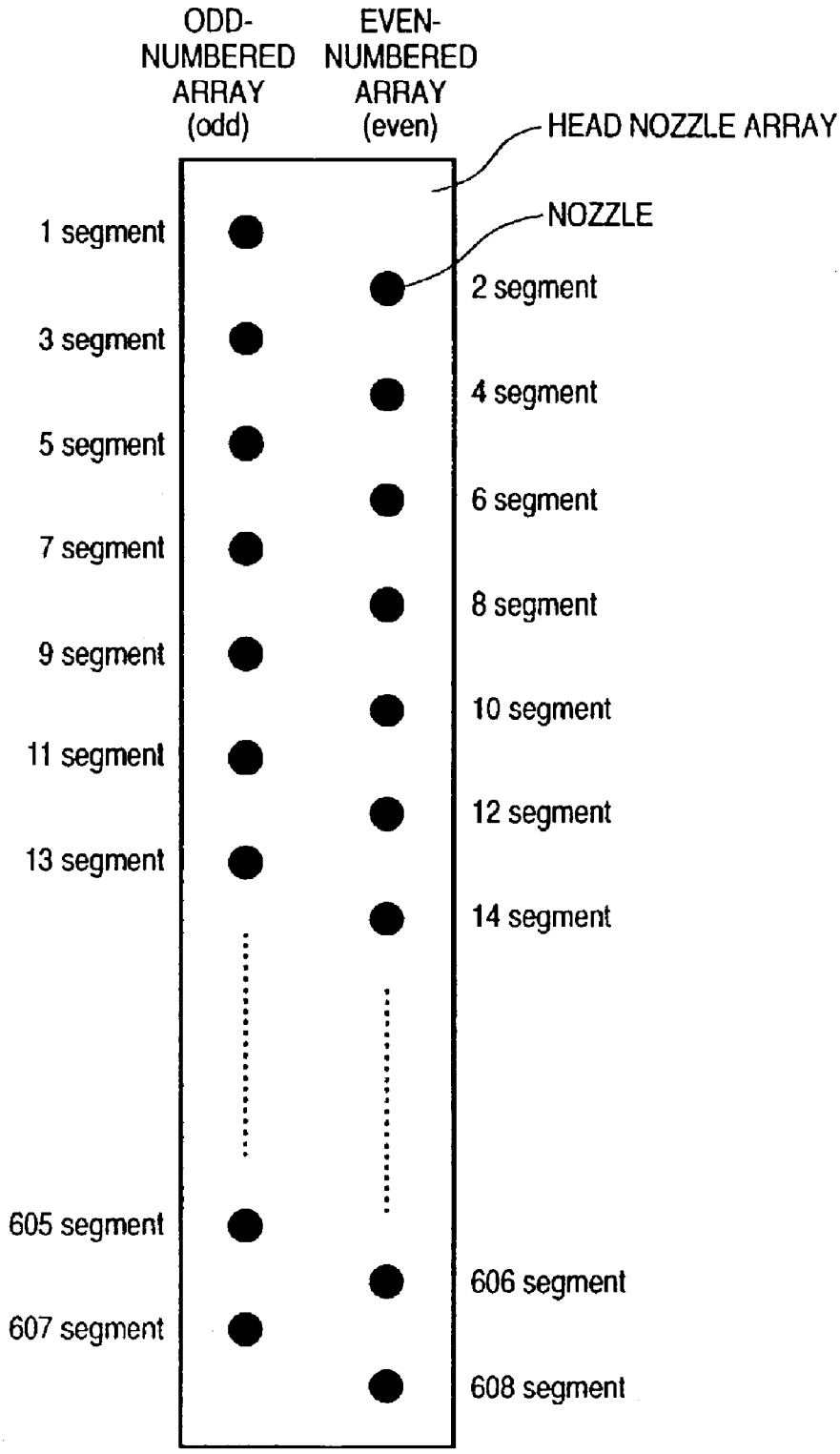
FIG. 15 is a view showing the arrangement of the nozzle array of the inkjet printhead according to the third embodiment of the present invention.

As shown in FIG. 15, the inkjet printhead 11 has two arrays of nozzles, i.e., even- and odd-numbered nozzles which are laid out in a staggered pattern at a density of 300 dpi. Each nozzle array has 304 nozzles. That is, the inkjet printhead 11 has a total of 608 nozzles. Each nozzle has a heating element for generating thermal energy.

In the third embodiment, the inkjet printhead 11 is formed by arraying eight printhead bases (chips) having 38 heating elements in one block in a direction perpendicular to the scanning direction.

Time-divisional printing by time-divisional driving of this arrangement will be described with reference to FIG. 16.

Figure 16:
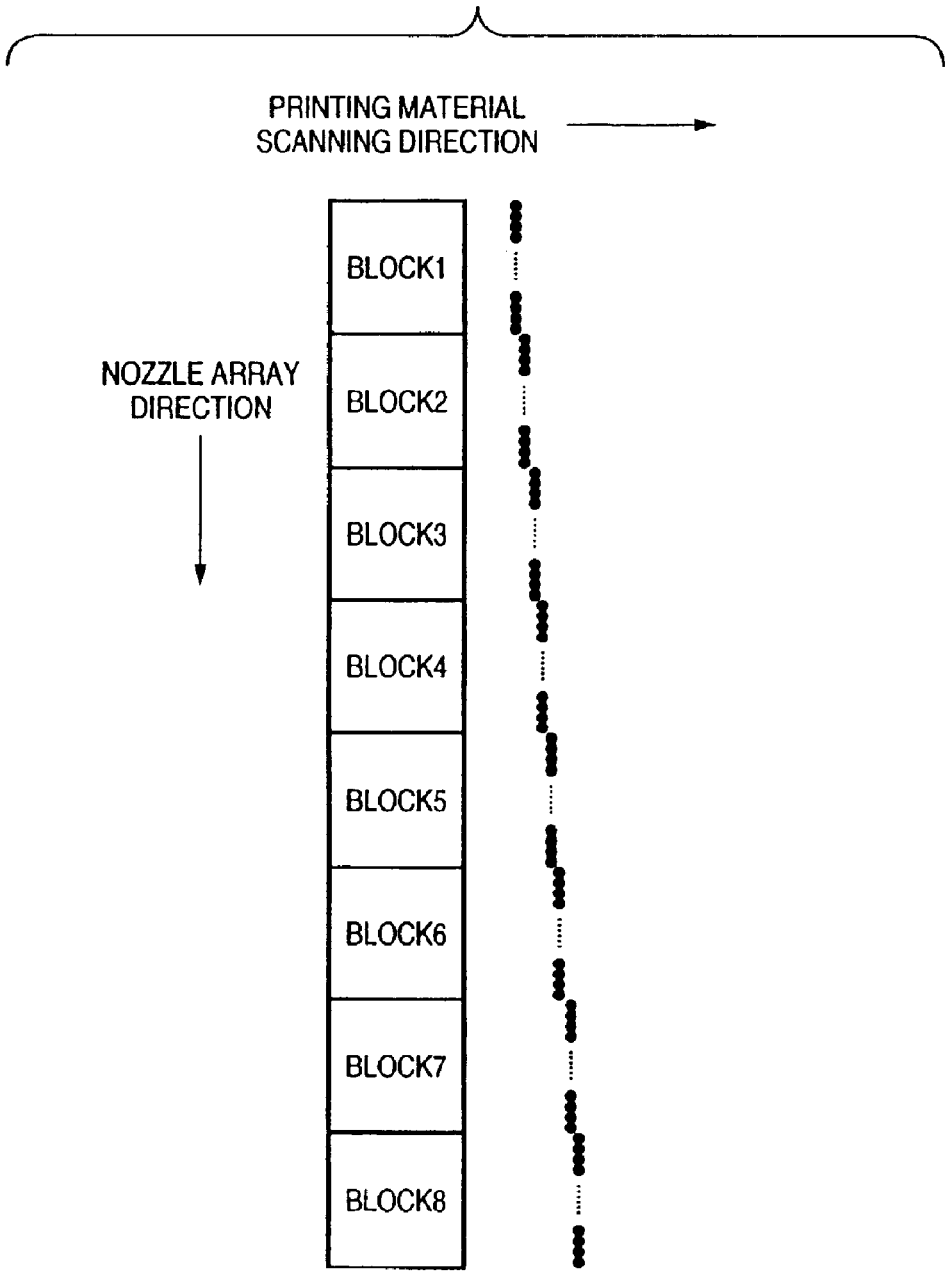
FIG. 16 is a view showing a state wherein printing is performed by time-divisionally driving the blocks of the inkjet printhead according to the third embodiment of the present invention.

FIG. 16 is a view showing a state wherein time-divisional printing is performed by the inkjet printhead according to the third embodiment of the present invention.

FIG. 16 shows the inkjet printhead 11 whose nozzle arrays are divided into eight blocks. It is however difficult to increase the number of blocks for time-divisional printing because of the driving period. Hence, in time-divisional control for eight blocks of nozzle arrays, when 304 nozzles in each column are simultaneously driven, all the 38 nozzles in each block are simultaneously driven.

In the third embodiment, each chip has a circuit arrangement shown in FIG. 13. However, the present invention is not limited to this. For example, a data output terminal (not shown) may be added to the shift register 2004 of each chip. The image data input pad 2006 may be shared such that image data that a given shift register 2004 cannot receive anymore is connected to the image data input pad 2006 of the shift register 2004 of the next chip to serially input the image data. The remaining signal may be basically parallelly input.

Driving conditions for the inkjet printhead 11 having the arrangement shown in FIG. 13 are set as follows. For example, the drive voltage is 17.2 V, and the double pulse which forms the drive signal of one cycle of discharge operation contains a pre-pulse of 0.65 $\mu$s, a pause of 1.14 $\mu$s, and a main pulse of 1.65 $\mu$s. A voltage drop depending on the number of nozzles in this case will be examined.

Under these driving conditions, for example, the difference between the voltage applied to the inkjet printhead 11 when ink is discharged from one nozzle of one block and the voltage applied to the inkjet printhead 11 when ink is discharged from all of the 38 nozzles of one block is 4.93 V. In other words, a voltage drop of 4.93 V is generated between the case wherein ink is discharged from one nozzle of one block and the case wherein ink is discharged from all of the 38 nozzles of one block. When the voltage drop is generated, ink discharge from all of the 38 nozzles of one block may be unstable.

To prevent this, the pulse width of the double pulse (the sum of the pre-pulse width and main pulse width) in the above driving conditions is corrected, thereby correcting the drive voltage corresponding to the voltage drop. Especially, in this example, the double pulse width in the driving conditions is corrected by 2.20 $\mu$s, thereby correcting the drive voltage corresponding to the voltage drop.

Figure 17:
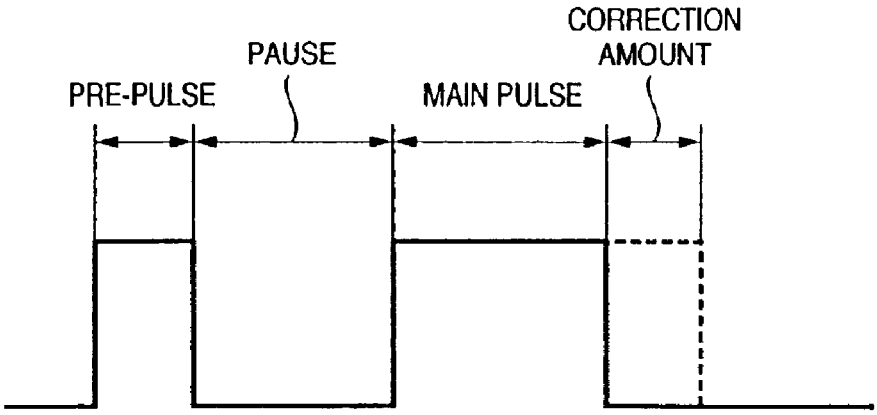
FIG. 17 is a timing chart for explaining pulse width correction according to the third embodiment of the present invention.

FIG. 17 shows a detailed example of the pulse width correction. In the double pulse waveform, when a correction amount indicated by the broken line is added to the main pulse, a predetermined input energy can always be applied to the inkjet printhead 11. Hence, the discharge performance when ink is discharged from one nozzle becomes the same as that when ink is simultaneously discharged from the 38 nozzles.

Voltage variations are acquired by actually driving the printhead and increasing the simultaneous discharge amount from 1 to 38. FIG. 18 is a table showing pulse width correction values used to correct the voltage variations. When this table is used, the simultaneous discharge count in one block in one cycle of discharge operation can be acquired in advance, and a voltage variation corresponding to the simultaneous discharge count can be predicted (determined) without actually measuring the voltage variation during driving. This table will be referred to as a voltage variation prediction table hereinafter.

This voltage variation prediction table may be prepared for each nozzle array (column) of the inkjet printhead 11 or shared. When voltage variations are acquired by actually driving the printhead and increasing the simultaneous discharge amount from 1 to 38 under different ambient temperatures, and pulse width correction values used to correct the voltage variations are listed, a plurality of voltage variation prediction tables corresponding to the ambient temperatures can be prepared.

In the third embodiment, the simultaneous discharge count of each of the plurality of blocks obtained by dividing the discharge columns (odd- and even-numbered arrays in the third embodiment) is calculated before the start of printing. On the basis of the calculated simultaneous discharge count, the pulse width of the drive signal is set for each block by looking up the voltage variation prediction table. With this processing, uniform discharge without any influence of the voltage variation depending on the simultaneous discharge count in one block can be realized. In addition, any printing error due to shortage of power by the voltage effect in the full discharge mode or any decease in service life of the inkjet printhead due to supply of an excessive current can be prevented. Furthermore, printing shift can be reduced, and high-quality printing can be realized.

FIG. 17 shows an example in which the drive signal corresponding to one cycle of discharge operation is formed from one pre-pulse and one main pulse. However, as in the first embodiment, the number of pre-pulses is not limited to one. The drive signal may be formed from a plurality of pre-pulses and one main pulse.

In the third embodiment, the waveform of the divided pulse is controlled by pulse width setting processing, thereby eliminating any adverse effect on ink discharge due to a variation in drive voltage and stabilizing discharge. Control of the waveform of the divided pulse includes control of the pulse width of at least one of the pre-pulse and main pulse, control of the interval between the pre-pulse and the main pulse, and control of the pulse heights of the pre-pulse and main pulse.

Processing executed by the inkjet printing apparatus 100 of the third embodiment will be described next with reference to FIG. 19.

Figure 19:
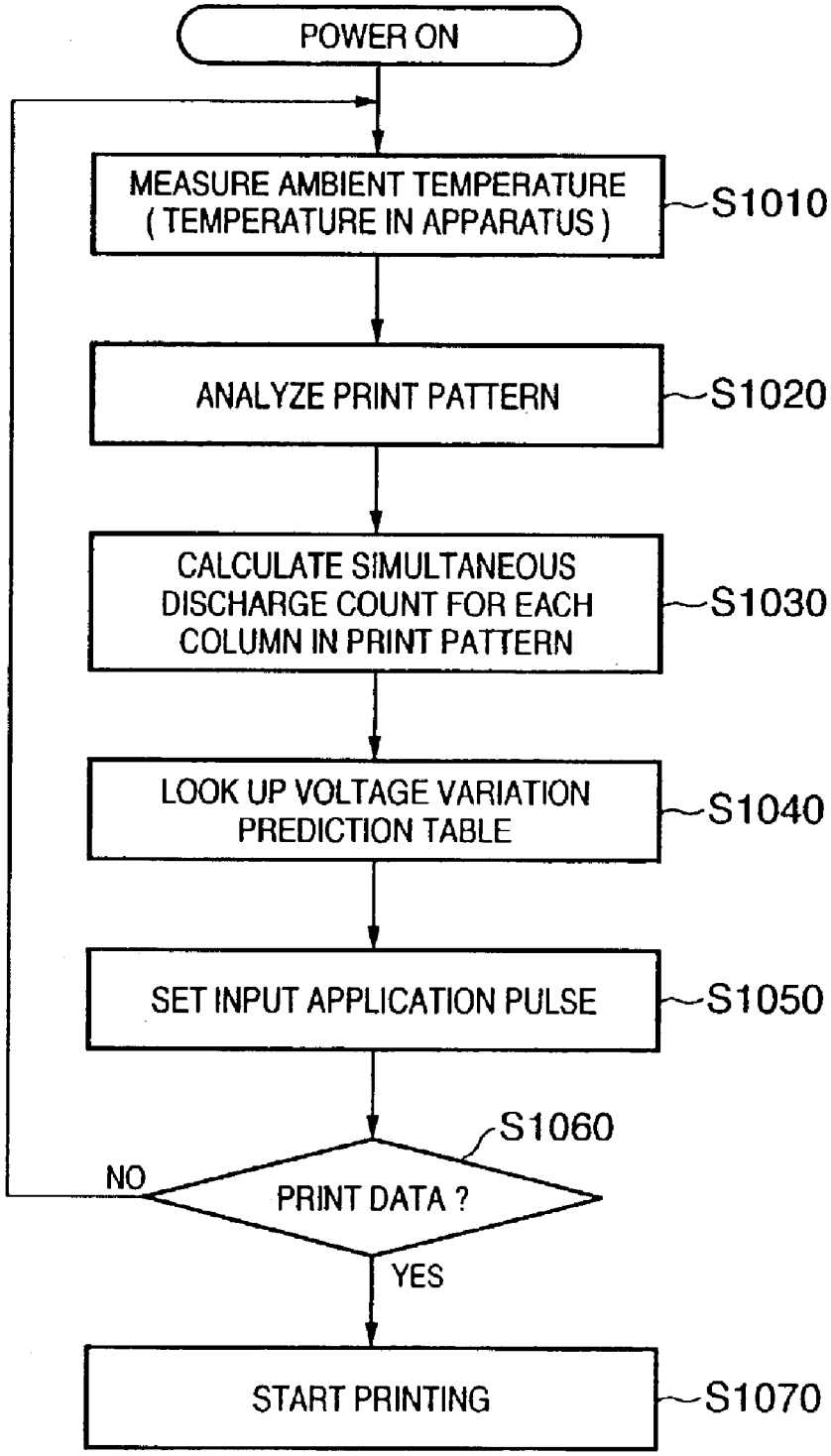
FIG. 19 is a flow chart showing processing executed by the inkjet printing apparatus according to the third embodiment of the present invention.

FIG. 19 is a flow chart showing processing executed by the inkjet printing apparatus according to the third embodiment of the present invention.

The processing executed in FIG. 19 may be realized by causing a CPU 30 to read out and execute a program stored in a program ROM 31 in the inkjet printing apparatus 100 or by dedicated hardware. The above-described voltage variation prediction table (FIG. 11) is stored in, e.g., the program ROM 31 or a backup RAM 32.

In step S1010, the apparatus is powered on. The ambient temperature (temperature in the apparatus) is measured by a temperature sensor 46 in the inkjet printing apparatus 100. In step S1020, print data containing a print pattern and the number of paper sheets to be printed is received for an external device through an external interface 47. The print pattern in the print data is analyzed.

In step S1030, the simultaneous discharge count in each column of the inkjet printhead 11 is calculated on the basis of the print pattern. In step S1040, a voltage drop amount corresponding to the simultaneous discharge count of each block in each column is determined as a predicted voltage variation by looking up the voltage variation prediction table (FIG. 11). Accordingly, a pulse correction value corresponding to the predicted voltage variation of each block can be obtained.

In step S1050, using the pulse correction value for each block as an application pulse condition, the input application pulse to be used for printing of each block in one cycle of discharge operation is set.

In step S1060, the presence/absence of print data is determined. If no print data is present (NO in step S1060), the flow returns to step S1010. If print data is present (YES in step S1060), the flow advances to step S1070 to start printing based on the print data.

As described above, according to the third embodiment, the variation in drive voltage of the inkjet printhead 11 is predicted on the basis of the simultaneous discharge count of each nozzle array of the inkjet printhead 11. A pulse correction value to be used to correct the voltage drop is determined in accordance with the prediction result. Accordingly, discharge can be stabilized, an application pulse condition for optimum input pulses can be set, and a high-quality image with a uniform density can be obtained.

In addition, the variation in drive voltage of the inkjet printhead 11 is predicted in advance from the simultaneous discharge count in one cycle of discharge operation of the inkjet printhead 11, which is determined from a print pattern, thereby setting the application pulse condition of input pulses for ink discharge before the start of printing.

Unlike the prior art, no complex and unreliable discharge stabilizing means need be used. It is therefore unnecessary to pre-read print data during printing and set the application pulse condition of input pulses on the basis of the read print data. The inkjet printing apparatus main body and inkjet printhead can be simplified. The cost can be largely reduced, and the discharge can be stabilized. Hence, an inexpensive and high-quality inkjet printing apparatus can be provided.

(Fourth Embodiment)

In the third embodiment, correction of an instantaneous voltage drop in the $\mu$s order in blocks obtained by dividing the nozzle arrays of the inkjet printhead 11 has been described. However, experiments and measurements by the present inventor have also revealed a voltage drop in the ms order between the main body of an inkjet printing apparatus 100 and an inkjet printhead 11.

Figure 20:
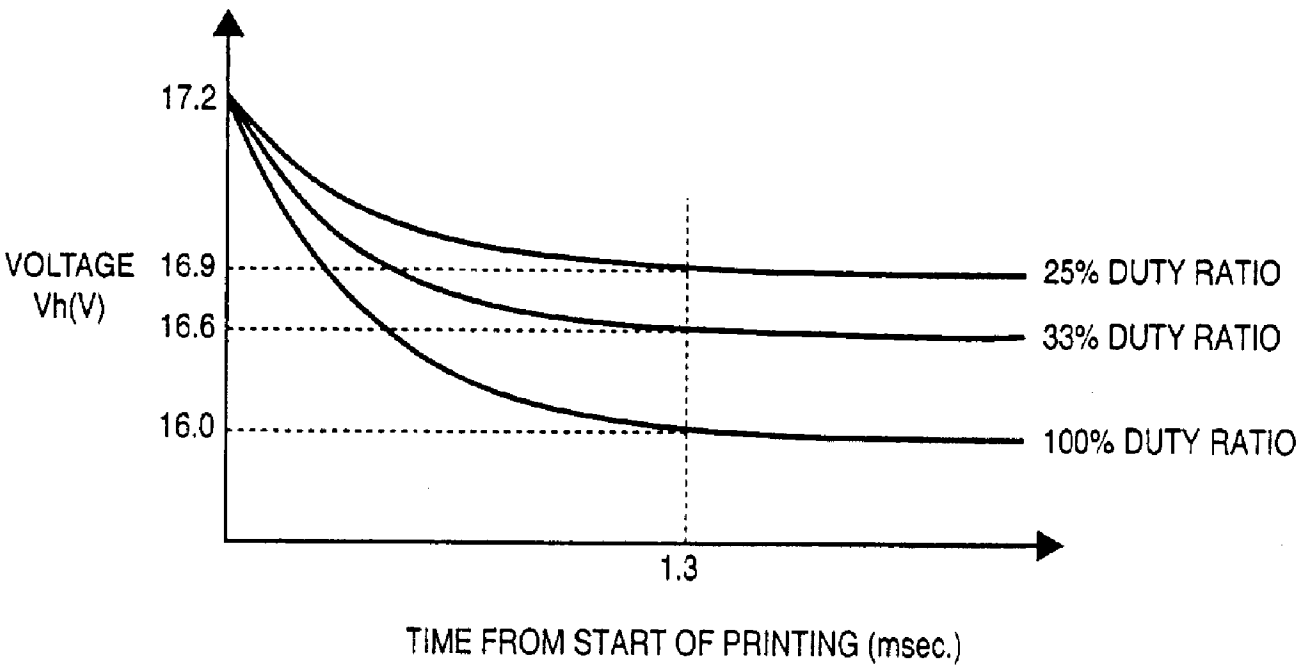
FIG. 20 is a graph showing voltage drops of an inkjet printing apparatus according to the fourth embodiment of the present invention.

FIG. 20 shows voltage drops of the drive voltage of the inkjet printhead 11 depending on the printing duty ratios (image printing densities) of an entire print pattern (FIG. 5).

FIG. 20 is a graph showing voltage drops corresponding to the printing duty ratios according to the fourth embodiment of the present invention.

Referring to FIG. 20, when the duty ratio is 100%, the drive voltage drops from 17.2 V to 16.0 V. When the duty ratio is 50%, the drive voltage drops from 17.2 V to 16.6 V. When the duty ratio is 25%, the drive voltage drops from 17.2 V to 16.9 V. The stabilizing time after printing starts until a predetermined voltage drop value is obtained is 1.3 msec.

Figure 21:
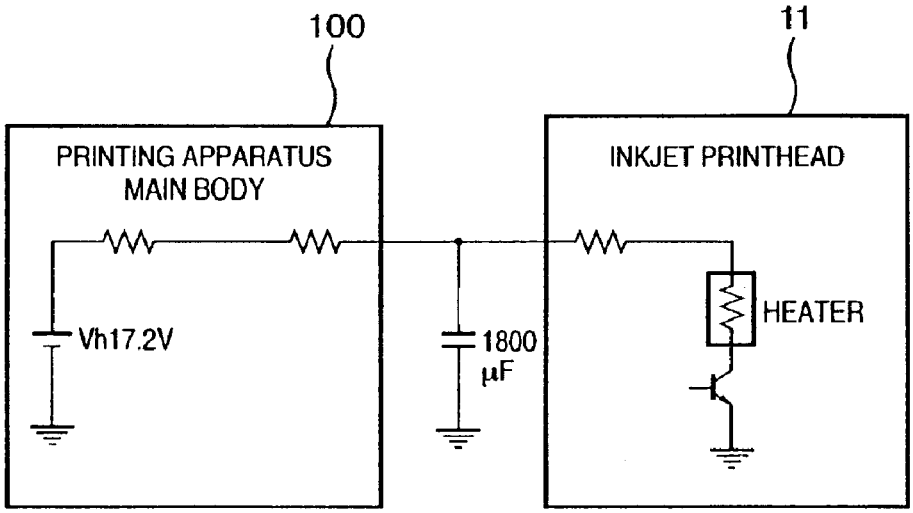
FIG. 21 is a simplified circuit diagram of the inkjet printing apparatus and inkjet printhead according to the fourth embodiment of the present invention.

The stabilizing time changes depending on the capacitance of the capacitor in the simplified circuit arrangement from the main body of the inkjet printing apparatus 100 to the inkjet printhead 11 as shown in FIG. 21. In the fourth embodiment, for example, when the capacitance of the capacitor is 1,800 $\mu$F, the voltage drop time constant is 1.3 msec.

The experiments by the present inventor have revealed the voltage drop value and voltage drop time constant corresponding to the duty ratio of a print pattern. Hence, when a voltage drop in the msec order is corrected by the same correction method as that of the third embodiment on the basis of the voltage drop value and voltage drop time constant, the discharge can be stabilized. When pulse width correction values to be used to correct the voltage variation corresponding to the duty ratio at a predetermined voltage drop time constant are listed in accordance with the same procedure as that of the third embodiment, a voltage variation prediction table for each duty ratio as shown in FIG. 22 can be obtained.

Processing executed by the inkjet printing apparatus 100 of the fourth embodiment will be described next with reference to FIG. 23.

Figure 23:
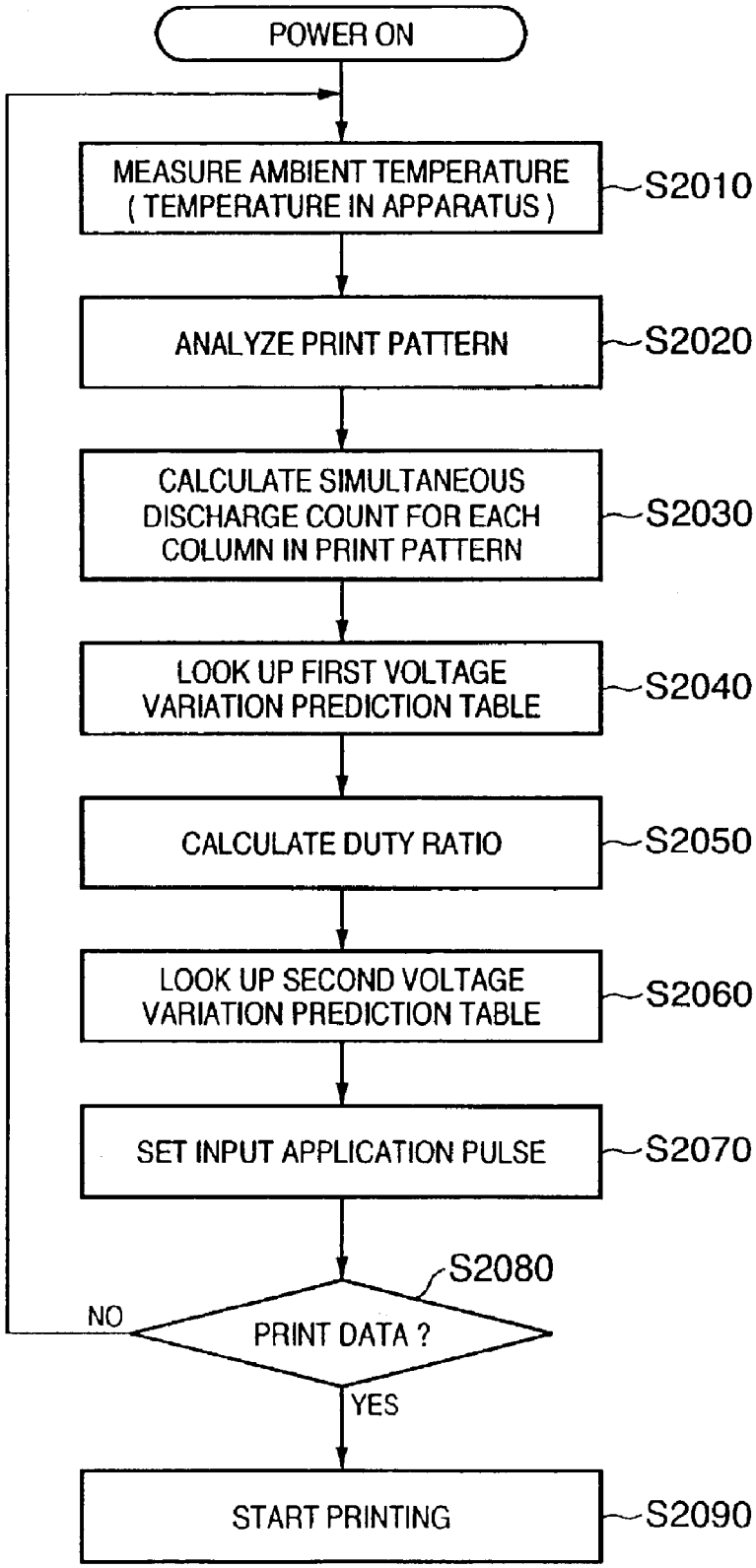
FIG. 23 is a flow chart showing processing executed by the inkjet printing apparatus according to the fourth embodiment of the present invention.

FIG. 23 is a flow chart showing processing executed by the printing apparatus according to the fourth embodiment of the present invention.

The processing executed in FIG. 23 may be realized by causing a CPU 30 to read out and execute a program stored in a program ROM 31 in the inkjet printing apparatus 100 or by dedicated hardware, as in the third embodiment. In the fourth embodiment, the voltage variation prediction table of the third embodiment (FIG. 18: first voltage variation prediction table) and the above-described voltage variation prediction table for each duty ratio (FIG. 22: second voltage variation prediction table) are used. These tables are stored in, e.g., the program ROM 31 or a backup RAM 32.

In step S2010, the apparatus is powered on. The ambient temperature (temperature in the apparatus) is measured by a temperature sensor 46 in the inkjet printing apparatus 100. In step S2020, print data containing a print pattern and the number of paper sheets to be printed is received for an external device through an external interface 47. The print pattern in the print data is analyzed.

In step S2030, the simultaneous discharge count in each column of the inkjet printhead 11 is calculated on the basis of the print pattern. In step S2040, a voltage drop amount corresponding to the simultaneous discharge count of each block in each column is determined as a first predicted voltage variation by looking up the first voltage variation prediction table (FIG. 18). Accordingly, a first pulse correction value corresponding to the first predicted voltage variation of each block can be obtained.

In step S2050, the duty ratio of the entire print pattern is calculated. In step S2060, a voltage drop amount corresponding to the duty ratio of the print pattern is determined as a second predicted voltage variation by looking up the second voltage variation prediction table (FIG. 22). Accordingly, a second pulse correction value corresponding to the second predicted voltage variation corresponding to the duty ratio of the print pattern can be obtained.

In step S2070, an input application pulse to be used for printing of each block is set using, as an application pulse condition, a pulse correction value obtained by adding the second pulse correction value to the first pulse correction value of each block.

In step S2080, the presence/absence of print data is determined. If no print data is present (NO in step S2080), the flow returns to step S2010. If print data is present (YES in step S2080), the flow advances to step S2090 to start printing based on the print data.

As described above, according to the fourth embodiment, in addition to the processing described in the third embodiment, a voltage drop amount corresponding to the duty ratio of a print pattern is predicted. A correction value to be used to correct a voltage variation is determined in accordance with the prediction result. With this processing, the discharge can be more accurately stabilized as compared to the first embodiment.

In the above embodiments, droplets discharged from orifices are ink droplets. The liquid stored in the ink tank is ink. However, it is not limited to ink. For example, a processing liquid which is discharged to a printing medium to increase fixing properties or water resistance of a printed image or increase the image quality may be stored in the ink tank.

In the above embodiments, of inkjet printing schemes, especially, a means (e.g., an electrothermal transducer or laser beam) for generating thermal energy as an energy to be used to discharge ink is prepared, and the state of the ink is changed by the thermal energy, thereby achieving high density and high accuracy of printing.

As the representative arrangement or principle, the basic principle disclosed in U.S. Pat. No. 4,723,129 or 4,740,796 is preferably used. This scheme can be applied to either a so-called on-demand type or continuous type printer. This scheme is especially effective to an on-demand type printer because when at least one drive signal corresponding to print information and instructing a rapid increase in temperature beyond film boiling temperature is applied to an electrothermal transducer arranged in correspondence with a sheet or channel in which a liquid (ink) is held, a thermal energy is generated in the electrothermal transducer, film boiling occurs on the plane of thermal action of the printhead, and finally, bubbles can be formed in the liquid (ink) corresponding to the drive signal in a one-to-one correspondence. The liquid (ink) is ejected from an election port as the bubbles grow or shrink, thereby forming at least one droplet. When this drive signal has a pulse shape, bubbles appropriately immediately grow or shrink. For this reason, the liquid (ink) can be ejected in a good response.

As the pulse-shaped drive signal, a signal described in U.S. Pat. No. 4,463,359 or 4,345,262 can suitably be used. When conditions described in U.S. Pat. No. 4,313,124 related to the temperature rise rate of the plane of thermal action is employed, more excellent printing can be performed.

For a full-line printhead having a length corresponding to the width of the largest printing medium usable for printing by the printing apparatus, either an arrangement that satisfies the length by combining a plurality of printheads, as disclosed in the above-described specification, or an arrangement as an integrally formed single printhead can be employed.

In addition, not only a cartridge type printhead formed by integrally attaching an ink tank to the printhead described in the above embodiments but also an interchangeable chip type printhead which is attached to the apparatus to be electrically connected to the apparatus main body or receive ink supply from the apparatus main body may be used.

It is preferable to add a recovery means or a preliminary means to the printhead in the above-described printing apparatus arrangement because the printing operation can be further stabilized. More specifically, a capping means, cleaning means, pressurizing means, or suction means for the printhead or a preheating means using an electrothermal transducer or another heating element or a combination thereof can be added. For more stable printing, it is also effective to prepare a predischarge mode different from the discharge mode at the time of printing.

The printing apparatus may have not only a printing mode for only its mainstream color such as black but also at least one of a multi-color mode with different colors and a full-color mode by color mixing using either an integrally formed printhead or a combination of a plurality of printheads.

The present invention can also be achieved by supplying a software program (in the embodiments, a program corresponding to the flow charts shown in the drawings), which implements the functions of the above-described embodiments, to the system or apparatus directly or from a remote site, and causing the computer of the system or apparatus to read out and execute the supplied program codes. In this case, the present invention only needs to have the functions of the program. The form of program is not always necessary.

The program codes which are installed in the computer to realize the functional processing of the present invention by that computer also implement the present invention by themselves. That is, the present invention also incorporates the computer program that implements the functional processing of the present invention.

In this case, the present invention only needs to have the functions of the program. The program can have any form such as object codes, a program to be executed by an interpreter, or script data to be supplied to an OS.

Examples of recording media for supplying the program are a floppy (registered trademark) disk, hard disk, optical disk, magnetooptical disk, MO, CD-ROM, CD-R, CD-RW, magnetic tape, nonvolatile memory card, ROM, and DVD (DVD-ROM or DVD-R).

The program can also be supplied by connecting the client computer to a homepage on the Internet using the browser of the computer and downloading the computer program of the present invention or a compressed file including an auto-install function from the homepage to a recording medium such as a hard disk. Alternatively, the program codes that construct the program of the present invention may be divided into a plurality of files, and the respective files may be downloaded from different homepages. That is, the present invention also incorporates a WWW server which causes a plurality of users to download the program files that implement the functional processing of the present invention in computers.

The present invention can also be implemented by encrypting the program of the present invention, storing the encrypted program in a storage medium such as a CD-ROM, distributing the media to users, allowing any user who satisfies predetermined conditions to download key information necessary for decrypting the program from a homepage through the Internet, and causing the user to use the key information to execute the encrypted program and install it in the computer.

The functions of the above-described embodiments are implemented not only by causing the computer to read out and execute the program but also by causing the OS running on the computer to execute part or all of actual processing on the basis of the instructions of the program.

The functions of the above-described embodiments are also implemented when the program read out from the recording medium is written in the memory of a function expansion board inserted into the computer or a function expansion unit connected to the computer, and the CPU of the function expansion board or function expansion unit performs part or all of actual processing on the basis of the instructions of the program.

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus which continuously prints a specific print pattern using a printhead, comprising:

input means for inputting print data containing the specific print pattern and the number of times the specific print pattern is to be printed;

prediction means for predicting a temperature of the printhead on the basis of the specific print pattern and the number of times the specific print pattern is to be printed; and setting means for setting a drive signal for the printhead before start of printing on the basis of a prediction result from said prediction means.

2. The apparatus according to claim 1, further comprising calculation means for calculating a duty ratio of the specific print pattern, first storage means for storing a continuous printing temperature rise prediction table that represents a relationship between the number of times the specific print pattern is to be printed and a temperature rise for the duty ratio of the specific print pattern, and second storage means for storing a setting table used to set the drive signal for the printhead on the basis of the temperature of the print head and the duty ratio of a predetermined block in the specific print pattern, wherein said prediction means predicts the temperature of the printhead on the basis of the specific print pattern and the number of times the specific print pattern is to be printed by looking up the continuous printing temperature rise prediction table, and said setting means sets the drive signal for the printhead before the start of printing on the basis of the temperature of the printhead, which is predicted by said prediction means, by looking up the setting table.

3. The apparatus according to claim 1, further comprising temperature detection means for detecting an ambient temperature of the inkjet printing apparatus, wherein said prediction means predicts the temperature of the printhead on the basis of the ambient temperature, the specific print pattern, and the number of times the specific print pattern is to be printed.

4. The apparatus according to claim 2, wherein the predetermined block is one of a block obtained by dividing the specific print pattern by a first predetermined length in a printing/scanning direction and a block obtained by dividing the specific print pattern by the first predetermined length and by a second predetermined length in a direction perpendicular to the printing/scanning direction.

5. The apparatus according to claim 1, wherein the drive signal is formed from a divided pulse having one or a plurality of pre-pulses and a main pulse for one cycle of printing operation.

6. The apparatus according to claim 5, wherein said setting means sets a waveform of the divided pulse of the drive signal before the start of printing.

7. The apparatus according to claim 5, wherein said setting means sets an interval between the pre-pulse and the main pulse of the drive signal before the start of printing.

8. A method of controlling an inkjet printing apparatus which continuously prints a specific print pattern using a printhead, comprising:

an input step of inputting print data containing the specific print pattern and the number of times the specific print pattern is to be printed;

a prediction step of predicting a temperature of the print head on the basis of the specific print pattern and the number of times the specific print pattern is to be printed; and a setting step of setting a drive signal for the printhead before start of printing on the basis of a prediction result in the prediction step.

9. The method according to claim 8, further comprising a calculation step of calculating a duty ratio of the specific print pattern, wherein in the prediction step, the temperature of the printhead is predicted on the basis of the specific print pattern and the number of times the specific print pattern is to be printed by looking up a continuous printing temperature rise prediction table that represents a relationship between the number of times the specific print pattern is to be printed and a temperature rise for the duty ratio of the specific print pattern, and in the setting step, the drive signal for the printhead is set before the start of printing on the basis of the temperature of the printhead, which is predicted in the prediction step, by looking up a setting table used to set the drive signal for the printhead on the basis of the temperature of the printhead and the duty ratio of a predetermined block in the specific print pattern.

10. The method according to claim 8, further comprising a temperature detection step of detecting an ambient temperature of the inkjet printing apparatus, wherein in the prediction step, the temperature of the printhead is detected on the basis of the ambient temperature, the specific print pattern, and the number of times the specific print pattern is to be printed.

11. The method according to claim 9, wherein the predetermined block is one of a block obtained by dividing the specific print pattern by a first predetermined length in a printing/scanning direction and a block obtained by dividing the specific print pattern by the first predetermined length and by a second predetermined length in a direction perpendicular to the printing/scanning direction.

12. The method according to claim 8, wherein the drive signal is formed from a divided pulse having one or a plurality of pre-pulses and a main pulse for one cycle of printing operation.

13. The method according to claim 12, wherein in the setting step, a waveform of the divided pulse of the drive signal is set before the start of printing.

14. The method according to claim 12, wherein in the setting step, an interval between the pre-pulse and the main pulse of the drive signal is set before the start of printing.

15. A program which causes a computer to function to control an inkjet printing apparatus which continuously prints a specific print pattern using a printhead, comprising:

a program code for an input step of inputting print data containing the specific print pattern and the number of times the specific print pattern is to be printed;

a program code for a prediction step of predicting a temperature of the printhead on the basis of the specific print pattern and the number of times the specific print pattern is to be printed; and a program code for a setting step of setting a drive signal for the printhead before start of printing on the basis of a prediction result in the prediction step.

* * * * *